US011661935B2

(12) United States Patent
Tanaka et al.

(10) Patent No.: US 11,661,935 B2
(45) Date of Patent: *May 30, 2023

(54) BLOWER

(71) Applicant: Murata Manufacturing Co., Ltd., Kyoto (JP)

(72) Inventors: Nobuhira Tanaka, Kyoto (JP); Daisuke Kondo, Kyoto (JP); Hiroaki Wada, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/170,171

(22) Filed: Feb. 8, 2021

(65) Prior Publication Data

US 2021/0164464 A1 Jun. 3, 2021

Related U.S. Application Data

(63) Continuation of application No. 15/906,282, filed on Feb. 27, 2018, now Pat. No. 10,947,965, which is a (Continued)

(30) Foreign Application Priority Data

Aug. 31, 2015 (JP) ..... JP2015-170507

(51) Int. Cl.
*F04B 45/047* (2006.01)
*F04B 43/02* (2006.01)
(Continued)

(52) U.S. Cl.
CPC ..... *F04B 45/047* (2013.01); *F04B 43/02* (2013.01); *F04B 43/043* (2013.01); *F04B 45/04* (2013.01)

(58) Field of Classification Search
CPC ..... F04B 43/02; F04B 43/043; F04B 45/04
See application file for complete search history.

(56) References Cited

U.S. PATENT DOCUMENTS

2005/0074662 A1 4/2005 Cho et al.
2011/0076170 A1 3/2011 Fujisaki et al.
(Continued)

FOREIGN PATENT DOCUMENTS

CN 102597519 A 7/2012
CN 102979706 A 3/2013
(Continued)

OTHER PUBLICATIONS

English Translation of WO 2013/179789 A1 obtained May 5, 2022 (Year: 2022).*
(Continued)

*Primary Examiner* — Connor J Tremarche
(74) *Attorney, Agent, or Firm* — Pearne & Gordon LLP

(57) ABSTRACT

A piezoelectric blower includes a valve unit, a pump unit, a controller, and an outer housing. The valve unit includes a plurality of ejection holes and film holes. The pump unit includes a plurality of communication holes and suction holes. The outer housing covers the valve unit and the pump unit with a gap between the outer housing and each of the valve unit and the pump unit. Thus, the outer housing forms vent passages between the outer housing and the valve unit and between the outer housing and the pump unit. The inlet communicates with the vent passage. The outlet communicates with the vent passage. At least one of the inlet and the outlet is displaced from a central axis of the pump chamber. The ejection holes, the film holes, the communication holes, and the suction holes are symmetric about the central axis of the pump chamber.

22 Claims, 20 Drawing Sheets

Related U.S. Application Data continuation of application No. PCT/JP2016/074578, filed on Aug. 24, 2016.

(51) Int. Cl.
*F04B 43/04* (2006.01)
*F04B 45/04* (2006.01)

(56) References Cited

U.S. PATENT DOCUMENTS

| | | | | |
|---|---|---|---|---|
| 2011/0190670 | A1* | 8/2011 | Jaeb | F04B 43/046 601/6 |
| 2012/0085949 | A1 | 4/2012 | Chen et al. | |
| 2012/0171062 | A1 | 7/2012 | Kodama et al. | |
| 2012/0195774 | A1 | 8/2012 | Kanai et al. | |
| 2013/0058809 | A1 | 3/2013 | Hirata et al. | |
| 2013/0071269 | A1 | 3/2013 | Fujisaki et al. | |
| 2013/0209278 | A1 | 8/2013 | Locke et al. | |
| 2014/0336599 | A1* | 11/2014 | Patel | A61M 1/79 604/319 |
| 2014/0377099 | A1 | 12/2014 | Hsueh et al. | |
| 2015/0071797 | A1* | 3/2015 | Takeuchi | F04B 43/0054 417/413.2 |
| 2015/0150470 | A1 | 6/2015 | Sano et al. | |
| 2016/0076530 | A1* | 3/2016 | Chen | F04B 45/047 417/413.2 |

FOREIGN PATENT DOCUMENTS

| | | | | |
|---|---|---|---|---|
| CN | 104302913 | A | 1/2015 | |
| CN | 104364526 | A | 2/2015 | |
| JP | 2000-265964 | A | 9/2000 | |
| JP | 2005-113918 | A | 4/2005 | |
| JP | 2005-229038 | A | 8/2005 | |
| JP | 2009-250132 | A | 10/2009 | |
| JP | 2012-237303 | A | 12/2012 | |
| JP | 2013-050108 | A | 3/2013 | |
| JP | 2013-068215 | A | 4/2013 | |
| JP | 5692468 | B2 | 4/2015 | |
| WO | 2011/068144 | A1 | 6/2011 | |
| WO | 2011/145544 | A1 | 11/2011 | |
| WO | 2013/187271 | A1 | 12/2013 | |
| WO | WO-2013179789 | A1 * | 12/2013 | A61B 5/02141 |
| WO | 2014/024608 | A1 | 2/2014 | |

OTHER PUBLICATIONS

International Search Report for International Application No. PCT/JP2016/074578 dated Nov. 8, 2016.

Written Opinion for International Application No. PCT/JP2016/074578 dated Nov. 8, 2016.

Japanese Reason For Rejection for Japanese Patent Application No. 2017-537773, dated Dec. 4, 2018.

Chinese Office Action for Chinese Patent Application No. 201680049391.3, dated Jun. 5, 2019.

* cited by examiner

BLOWER

CROSS REFERENCE TO RELATED APPLICATIONS

This is a continuation of U.S. patent application Ser. No. 15/906,282 filed on Feb. 27, 2018, which is a continuation of International Application No. PCT/JP2016/074578 filed on Aug. 24, 2016 which claims priority from Japanese Patent Application No. JP 2015-170507 filed on Aug. 31, 2015. The contents of these applications are incorporated herein by reference in their entireties.

BACKGROUND OF THE DISCLOSURE

Field of the Disclosure

The present disclosure relates to a blower that transports gas.

Description of the Related Art

Blowers that transport gas, such as air, are in widespread use. For example, Patent Document 1 discloses a piezoelectric micro-blower.

FIG. 20 is a sectional view of a piezoelectric micro-blower A according to Patent Document 1. The piezoelectric micro-blower A includes a vibrating plate 921, a piezoelectric element 920, a pump housing 910, and an outer housing 950. The vibrating plate 921 and the piezoelectric element 920 form an actuator 902.

The piezoelectric element 920 expands and contracts when an alternating voltage is applied thereto, and thereby causes the vibrating plate 921 to vibrate. The pump housing 910 is connected to the vibrating plate 921 so as to form a pump chamber 903. The outer housing 950 covers the pump housing 910 with a gap therebetween.

The pump housing 910 has a vent hole 911 through which the inside of the pump chamber 903 communicates with the outside of the pump chamber 903. The vent hole 911 is symmetric about a central axis C of the pump chamber 903. The outer housing 950 defines a vent passage 906, which communicates with the vent hole 911, between the outer housing 950 and the pump housing 910. The outer housing 950 has an inlet 951 and an outlet 953 that communicate with the vent passage 906.

The vent passage 906 is axisymmetric about the central axis C. Therefore, the distance from the central axis C to the left end of the vent passage 906 (the left inner wall surface of the outer housing 950) is equal to the distance from the central axis C to the right end of the vent passage 906 (the right inner wall surface of the outer housing 950).

In the piezoelectric micro-blower A having the above-described structure, the actuator 902 may be driven at a frequency higher than an audible frequency to prevent the generation of uncomfortable noise that is audible to the user.

Patent Document 1: Japanese Unexamined Patent Application Publication No. 2013-50108

BRIEF SUMMARY OF THE DISCLOSURE

However, when the actuator 902 included in the piezoelectric micro-blower A according to Patent Document 1 is driven at a high frequency, a high-frequency pressure wave is outputted to the vent passage 906 through the vent hole 911. The pressure wave outputted through the vent hole 911 propagates through the vent passage 906, and is reflected by an inner wall surface of the outer housing 950. When the frequency is high, the wave length of the pressure wave is short, and the pressure wave has antinodes in the vent passage 906. As the frequency increases, the number of antinodes in the vent passage 906 increases. The vent passage 906 is axisymmetric about the central axis C.

Accordingly, the pressure wave reflected at the left end of the vent passage 906 and the pressure wave reflected at the right end of the vent passage 906 enhance each other at a plurality of locations in the vent passage 906. Therefore, a large pressure amplitude occurs in the vent passage 906. In other words, a large energy loss occurs in the vent passage 906.

Thus, the piezoelectric micro-blower A according to Patent Document 1 has a problem that the pump characteristics (for example, discharge pressure and discharge flow rate) thereof are degraded.

Accordingly, an object of the present disclosure is to provide a blower capable of inhibiting the degradation of pump characteristics.

A blower according to the present disclosure includes a pump unit and an outer housing. The pump unit includes a vibrating body, a driving body that vibrates the vibrating body, and a pump housing that is connected to the vibrating body so as to form a pump chamber. The outer housing covers the pump unit with a gap therebetween.

The pump unit has a vent hole through which an inside of the pump chamber communicates with an outside of the pump chamber, the vent hole being symmetric about a central axis of the pump chamber. The outer housing defines a vent passage, which communicates with the vent hole, between the outer housing and the pump unit, and has an inlet and an outlet that communicate with the vent passage. At least one of the inlet and the outlet is displaced from the central axis of the pump chamber.

In this structure, when the driving body is driven at a predetermined frequency, a pressure wave is outputted to the vent passage through the vent hole. The pressure wave outputted through the vent hole propagates through the vent passage and is reflected at both ends of the vent passage (the inner wall surfaces of the outer housing). When the frequency is high, the pressure wave have a short wave length, and therefore have antinodes in the vent passage. The predetermined frequency is a frequency at which the pressure waves have antinodes in the vent passage (for example, 10 kHz or higher).

However, in this structure, most of the pressure wave reflected at one end of the vent passage is discharged to the outside of the outer housing through at least one of the inlet and the outlet. Accordingly, for example, the pressure wave reflected at the left end of the vent passage and the pressure wave reflected at the right end of the vent passage do not greatly enhance each other in the vent passage. As a result, a large pressure amplitude does not occur in the vent passage. In other words, a large energy loss does not occur in the vent passage.

Thus, in the blower having the above-described structure, the degradation of the pump characteristics (for example, discharge pressure and discharge flow rate) can be inhibited.

In the blower according to the present disclosure, preferably, the inlet and the outlet are both displaced from the central axis of the pump chamber.

In this structure, most of the pressure wave reflected at one end of the vent passage is discharged to the outside of the outer housing through the inlet and the outlet. Accordingly, for example, the pressure wave reflected at the left end of the vent passage and the pressure wave reflected at the right end of the vent passage do not greatly enhance each other in the vent passage. As a result, a large pressure amplitude does not occur in the vent passage. In other words, a large energy loss does not occur in the vent passage.

Thus, in the blower having the above-described structure, the degradation of the pump characteristics (for example, discharge pressure and discharge flow rate) can be inhibited.

A blower according to the present disclosure includes a pump unit and an outer housing. The pump unit includes a vibrating body, a driving body that vibrates the vibrating body, and a pump housing that is connected to the vibrating body so as to form a pump chamber. The outer housing covers the pump unit with a gap therebetween.

The pump unit has a vent hole through which an inside of the pump chamber communicates with an outside of the pump chamber. The outer housing defines a vent passage, which communicates with the vent hole, between the outer housing and the pump unit, and has an inlet and an outlet that communicate with the vent passage. A distance from the central axis to a first end of the vent passage differs from a distance from the central axis to a second end of the vent passage.

In this structure, the phase of the pressure wave reflected at the first end of the vent passage is shifted from the phase of the pressure wave reflected at the second end of the vent passage. Therefore, the pressure wave reflected at the first end of the vent passage and the pressure wave reflected at the second end of the vent passage do not greatly enhance each other in the vent passage. As a result, a large pressure amplitude does not occur in the vent passage. In other words, a large energy loss does not occur in the vent passage.

Thus, in the blower having the above-described structure, the degradation of the pump characteristics (for example, discharge pressure and discharge flow rate) can be inhibited.

In the blower according to the present disclosure, the pump chamber and the valve chamber preferably have the same central axis. In addition, in the blower according to the present disclosure, the pump chamber is preferably axisymmetric about the central axis.

In this structure, when the driving body is driven at a high frequency, a pressure wave is generated in the pump chamber. The pressure wave generated in the pump chamber propagates through the pump chamber, and is reflected at both ends of the pump chamber (the inner side surfaces of the pump housing). In this structure, for example, the phase of the pressure wave reflected at the left end of the pump chamber matches the phase of the pressure wave reflected at the right end of the pump chamber. Therefore, the pressure wave reflected at the left end of the pump chamber and the pressure wave reflected at the right end of the pump chamber enhance each other. As a result, a large pressure wave is outputted from the vent hole.

Accordingly, the pump characteristics of the blower having the above-described structure can be improved.

In the blower according to the present disclosure, at least one of the inlet and the outlet is preferably provided in a side surface of the outer housing.

In this structure, only the phase of a pressure wave reflected at end portions of the vent passage at which the inlet and the outlet are provided is reversed, and becomes opposite to the phase of a pressure wave reflected at other end portions. Thus, the pressure waves cancel each other in the vent passage. As a result, a large pressure amplitude does not occur in the vent passage. In other words, a large energy loss does not occur in the vent passage.

Thus, in the blower having the above-described structure, the degradation of the pump characteristics (for example, discharge pressure and discharge flow rate) can be inhibited.

In this structure, when a tube is attached to at least one of the inlet and the outlet, the tube is attached to the side surface of the outer housing. Thus, the height of the blower having this structure can be reduced.

In the blower according to the present disclosure, preferably, the inlet and the outlet are both provided in the side surface of the outer housing.

In this structure, when tubes are attached to the inlet and the outlet, the tubes are attached to the side surface of the outer housing. Thus, the height of the blower having this structure can be reduced.

In the blower according to the present disclosure, preferably, the outer housing includes a first nozzle that surrounds the inlet and a second nozzle that surrounds the outlet, and one of the first nozzle and the second nozzle is disposed on a straight line that is orthogonal to the central axis of the pump chamber.

In this structure, no moment is generated when a tube is attached to one of the first nozzle and the second nozzle that is disposed on the straight line that is orthogonal to the central axis of the pump chamber, and therefore the outer housing does not rotate. Thus, the tube can be easily attached to and removed from the blower having the above-described structure.

In the blower according to the present disclosure, preferably, the outer housing includes a first nozzle that surrounds the inlet and a second nozzle that surrounds the outlet, and the first nozzle and the second nozzle are disposed at positions that oppose each other.

In this structure, forces generated when two tubes are simultaneously attached to or removed from the first nozzle and the second nozzle cancel each other, and therefore the outer housing is not displaced. Thus, the tubes can be more easily attached to and removed from the blower having the above-described structure.

In the blower according to the present disclosure, preferably, the outer housing includes a first nozzle that surrounds the inlet and a second nozzle that surrounds the outlet, and an angle between a central axis of the first nozzle and a central axis of the second nozzle is smaller than or equal to 90 degrees.

When two tubes are attached to the first nozzle and the second nozzle while the blower having the above-described structure is disposed at a corner between two wall portions, the outer housing is supported by the two wall portions. The wall portions are, for example, portions of a housing of an electronic device in which the blower having the above-described structure is mounted. Thus, the tubes can be more easily attached to the blower having the above-described structure.

According to the present disclosure, the reduction in pump characteristics can be inhibited.

DETAILED DESCRIPTION OF THE DISCLOSURE

First Embodiment of Present Disclosure

A piezoelectric blower 100 according to a first embodiment of the present disclosure will now be described.

Figure 1:
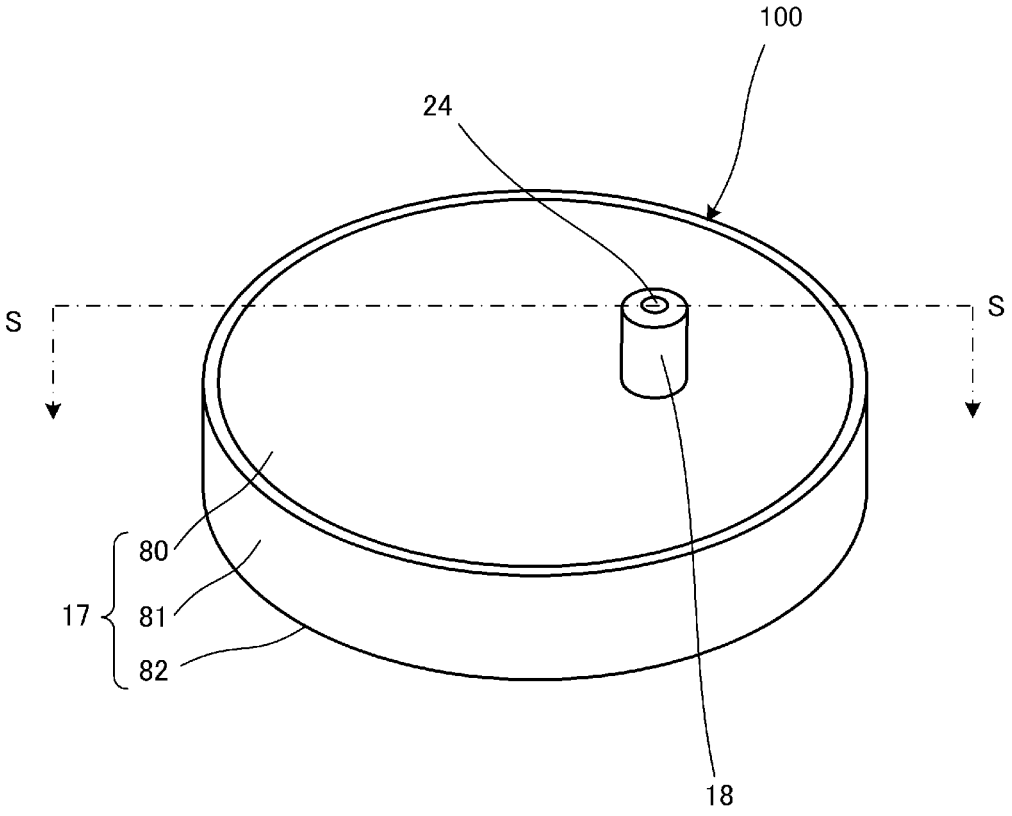
FIG. 1 is an external perspective view of a piezoelectric blower 100 according to a first embodiment of the present disclosure.
Figure 2:
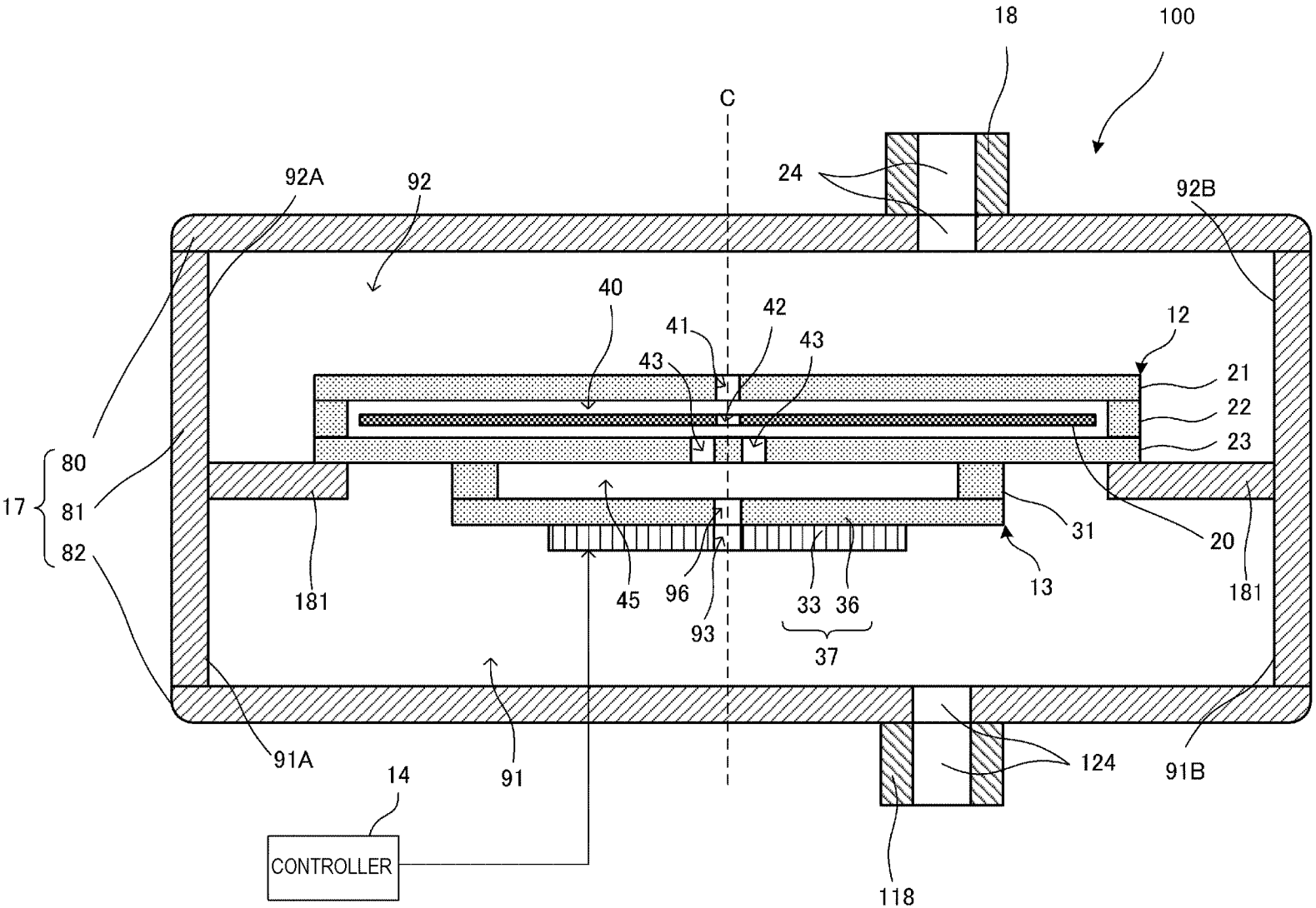
FIG. 2 is a sectional view of the piezoelectric blower 100 illustrated in FIG. 1 taken along line S-S.
Figure 3:
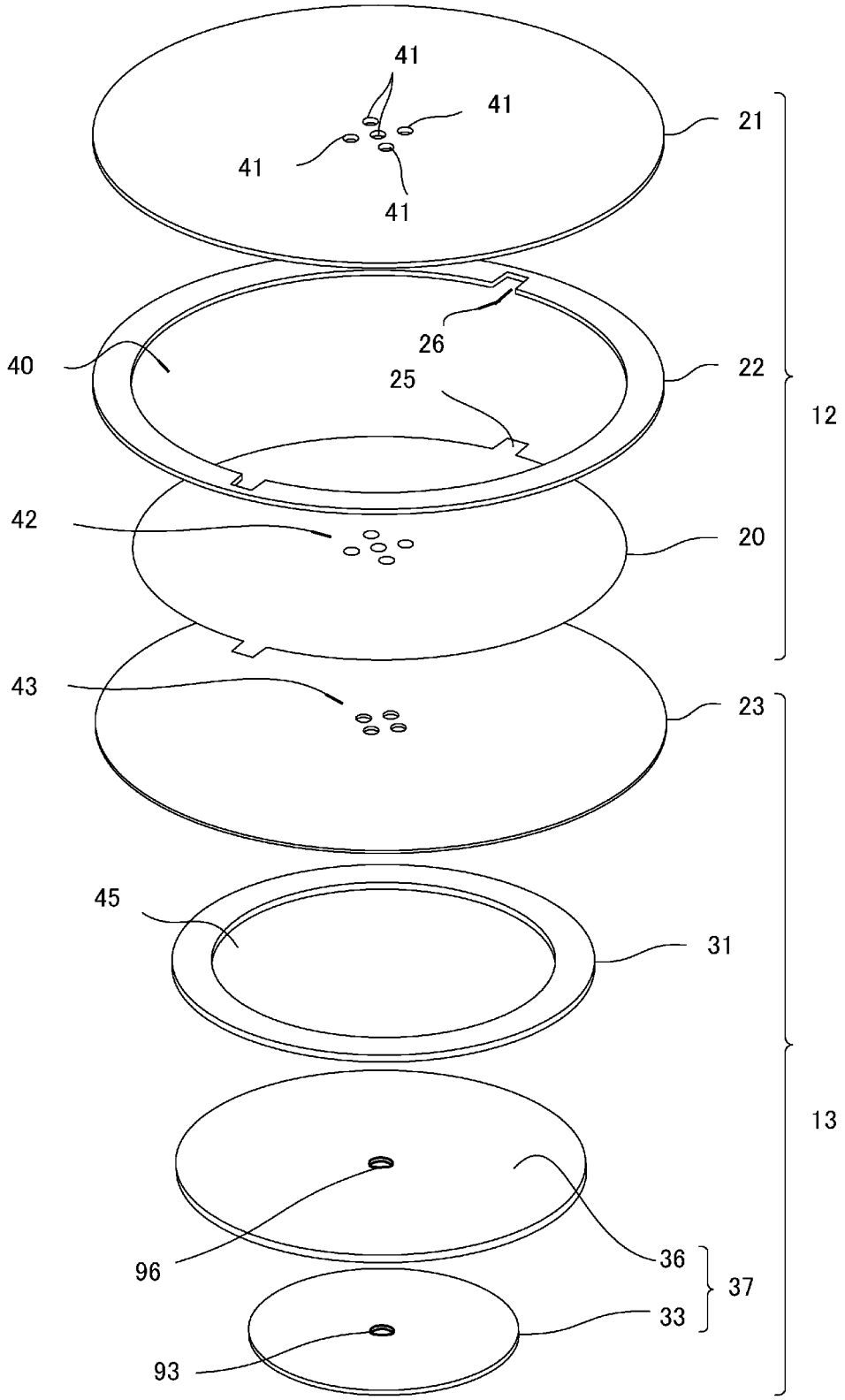
FIG. 3 is an exploded perspective view of a valve unit 12 and a pump unit 13 illustrated in FIG. 2.
Figure 4:
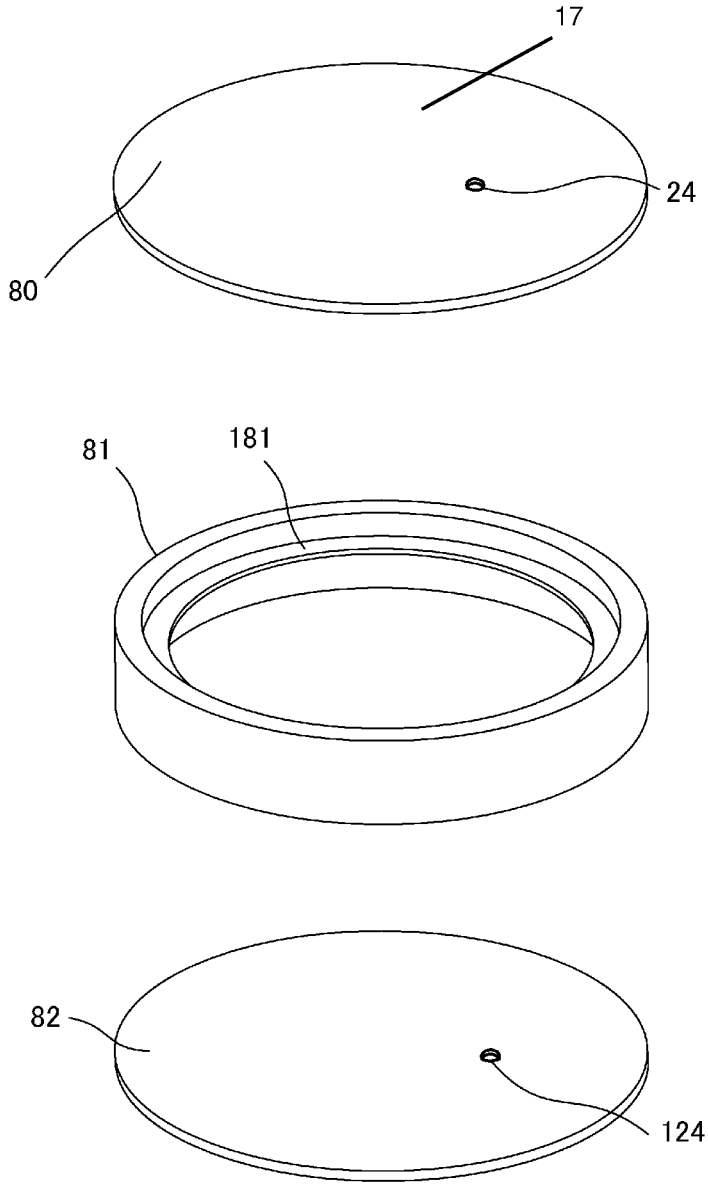
FIG. 4 is an exploded perspective view of an outer housing 17 illustrated in FIG. 2.

FIG. 1 is an external perspective view of a piezoelectric blower 100 according to a first embodiment of the present disclosure. FIG. 2 is a sectional view of the piezoelectric blower 100 illustrated in FIG. 1 taken along line S-S. FIG. 3 is an exploded perspective view of a valve unit 12 and a pump unit 13 illustrated in FIG. 2. FIG. 4 is an exploded perspective view of an outer housing 17 illustrated in FIG. 2. In FIG. 4, nozzles 18 and 118 are omitted.

As illustrated in FIGS. 1 and 2, the piezoelectric blower 100 includes a valve unit 12, a pump unit 13, a controller 14, and an outer housing 17. The piezoelectric blower 100 transports gas, such as air.

The valve unit 12 and the pump unit 13 are laminated together. As illustrated in FIGS. 2 and 3, the valve unit 12 is disposed in an upper section of the piezoelectric blower 100. As illustrated in FIGS. 2 and 3, the pump unit 13 is disposed in a lower section of the piezoelectric blower 100.

As illustrated in FIGS. 2 and 4, the outer housing 17 includes a top plate 80, a side plate 81, a bottom plate 82, a nozzle 18, an outlet 24, a nozzle 118, an inlet 124, and a receiving portion 181. The outer housing 17 has a hollow cylindrical shape. The outer housing 17 is made of, for example, a resin. Tubes (not shown) are attached to the nozzles 18 and 118.

The top plate 80 is disc-shaped. The bottom plate 82 is also disc-shaped. The side plate 81 is annular-shaped. The side plate 81 has the receiving portion 181, which projects toward a central axis C of a pump chamber 45 from the inner peripheral surface of the side plate 81. The receiving portion 181 is annular-shaped. The valve unit 12 and the pump unit 13 are placed on the receiving portion 181, and the periphery of the valve unit 12 is attached to the receiving portion 181. The outlet 24, through which gas is discharged, is formed in the nozzle 18. The inlet 124, through which gas is introduced, is formed in the nozzle 118.

The outer housing 17 covers the valve unit 12 and the pump unit 13 with a gap between the outer housing 17 and each of the valve unit 12 and the pump unit 13. Thus, vent passages 91 and 92 are formed between the outer housing 17 and the valve unit 12 and between the outer housing 17 and the pump unit 13. The vent passage 91 is axisymmetric about the central axis C. Therefore, the distance from the central axis C to a left end 91A of the vent passage 91 (the left inner wall surface of the outer housing 17) is equal to the distance from the central axis C to a right end 91B of the vent passage 91 (the right inner wall surface of the outer housing 17).

The vent passage 92 is also axisymmetric about the central axis C. Therefore, the distance from the central axis C to a left end 92A of the vent passage 92 (the left inner wall surface of the outer housing 17) is equal to the distance from the central axis C to a right end 92B of the vent passage 92 (the right inner wall surface of the outer housing 17). The inlet 124 communicates with the vent passage 91. The outlet 24 communicates with the vent passage 92. The inlet 124 and the outlet 24 are both displaced from the central axis C of the pump chamber 45.

The valve unit 12 and the pump unit 13 constitute an example of a "pump unit" according to the present disclosure. An upper plate 23 and a side wall plate 31 constitute an example of a "pump housing" according to the present disclosure. Each of the vent passages 91 and 92 corresponds to an example of a "vent passage" according to the present disclosure.

The pump unit 13 is a diaphragm pump including a vibrating plate 36 (diaphragm). As illustrated in FIGS. 2 and 3, the pump unit 13 has the shape of a hollow cylindrical container in which the pump chamber 45 is formed. The pump chamber 45 is axisymmetric about the central axis C. The pump chamber 45 is cylindrical.

The pump unit 13 includes the upper plate 23, the side wall plate 31, the vibrating plate 36, and a piezoelectric element 33. The upper plate 23, the side wall plate 31, the vibrating plate 36, and the piezoelectric element 33 are laminated together. The upper plate 23, the side wall plate 31, and the vibrating plate 36 are connected together to form the pump chamber 45. The upper plate 23, the side wall plate 31, and the vibrating plate 36 are made of a metal. For example, the upper plate 23, the side wall plate 31, and the vibrating plate 36 are made of stainless steel.

The upper plate 23 is disc-shaped. A plurality of communication holes 43 arranged in a predetermined pattern are formed in a central portion of the upper plate 23. The top surface of the side wall plate 31 is attached to the bottom surface of the upper plate 23.

The side wall plate 31 is annular-shaped. The pump chamber 45, which has a predetermined opening diameter, is formed at the center of the side wall plate 31. The side wall plate 31 and the vibrating plate 36 have the same outer diameter. The outer diameter of the side wall plate 31 and the vibrating plate 36 is smaller than the outer diameter of the valve unit 12 by a predetermined amount. The top surface of the vibrating plate 36 is attached to the bottom surface of the side wall plate 31. The vibrating plate 36 is disc-shaped. The vibrating plate 36 has a suction hole 96 at the center thereof.

The piezoelectric element 33 is disc-shaped. The diameter of the piezoelectric element 33 is smaller than the diameter of the vibrating plate 36. The piezoelectric element 33 has a suction hole 93 at the center thereof. The top surface of the piezoelectric element 33 is attached to the bottom surface of the vibrating plate 36. The piezoelectric element 33 is made of, for example, a lead zirconate titanate ceramic.

Electrodes (not shown) are formed on both principal surfaces of the piezoelectric element 33, and the controller 14 applies a driving voltage across these electrodes. The piezoelectric element 33 has piezoelectric properties such that the piezoelectric element 33 expands and contracts in a planar direction in response to the applied driving voltage.

Therefore, when the piezoelectric element 33 receives the driving voltage, the piezoelectric element 33 expands and contracts in the planar direction. The expansion and contraction of the piezoelectric element 33 generates a concentric bending vibration of the vibrating plate 36. Thus, the piezoelectric element 33 and the vibrating plate 36 constitute a piezoelectric actuator 37 and vibrate together.

The vibrating plate 36 corresponds to an example of a "vibrating body" according to the present disclosure. The piezoelectric element 33 corresponds to an example of a "driving body" according to the present disclosure.

The valve unit 12 has a function of regulating the flow of gas in one direction. The valve unit 12 has the shape of a hollow cylindrical container in which a valve chamber 40 is formed. The valve unit 12 is cylindrical. As illustrated in FIGS. 2 and 3, the valve unit 12 includes a cover plate 21, a side wall plate 22, and a film 20.

The cover plate 21 and the side wall plate 22 are made of a metal. For example, the cover plate 21 and the side wall plate 22 are made of stainless steel (SUS). The film 20 is made of a resin. For example, the film 20 is made of a translucent polyimide.

The cover plate 21 is disposed at the top of the valve unit 12. The side wall plate 22 is disposed between the cover plate 21 and the upper plate 23. The upper plate 23 is disposed on the bottom surface of the valve unit 12. The cover plate 21, the side wall plate 22, and the upper plate 23 are laminated together. The film 20 is disposed in the inner space of the valve unit 12, that is, in the valve chamber 40.

The cover plate 21 is disc-shaped. The side wall plate 22 is annular-shaped. The cover plate 21, the side wall plate 22, and the upper plate 23 have the same outer diameter.

The valve chamber 40 is formed at the center of the side wall plate 22 and has a predetermined opening diameter. The film 20 is substantially disc-shaped. The film 20 has a thickness smaller than the thickness of the side wall plate 22.

In the present embodiment, for example, the thickness of the side wall plate 22 (the height of the valve chamber 40) is in the range from 40 μm to 50 μm, and the thickness of the film 20 is in the range from 5 μm to 10 μm. The film 20 is extremely light so that the film 20 can be moved in the valve chamber 40 in the up-down direction by air ejected from the pump unit 13.

The outer diameter of the film 20 is substantially equal to the opening diameter of the valve chamber 40 in the side wall plate 22. The outer diameter of the film 20 is slightly smaller than the opening diameter of the valve chamber 40 so that a small gap is provided. The film 20 has projections 25 at certain positions along the outer periphery thereof (see FIG. 3).

The side wall plate 22 has cut portions 26, which receive projections 25 with small gaps therebetween, at certain positions along the inner periphery thereof (see FIG. 3). Thus, the film 20 is held in the valve chamber 40 so as to be non-rotatable but movable in the up-down direction.

A plurality of ejection holes 41 arranged in a predetermined pattern are formed in a central portion of the cover plate 21. The communication holes 43 arranged in the predetermined pattern are formed in the central portion of the upper plate 23. A plurality of film holes 42 arranged in a predetermined pattern are formed in a central portion of the film 20. Thus, the valve chamber 40 communicates with the vent passage 92 through the ejection holes 41, and with the pump chamber 45 through the communication holes 43.

The ejection holes 41 and the communication holes 43 are arranged so as not to oppose each other. The film holes 42 and the ejection holes 41 are arranged so as to oppose each other. The film holes 42 and the communication holes 43 are arranged so as not to oppose each other.

The ejection holes 41, the film holes 42, the communication holes 43, and the suction holes 93 and 96 are symmetric about the central axis C of the pump chamber 45.

Each of the ejection holes 41, the film holes 42, the communication holes 43, and the suction holes 93 and 96 corresponds to an example of a "vent hole" according to the present disclosure.

Referring to FIG. 2, the controller 14 is constituted by, for example, a microcomputer. The controller 14 adjusts, for example, the driving frequency of the piezoelectric element 33 to the resonant frequency of the pump chamber 45. The resonant frequency of the pump chamber 45 is a frequency at which pressure vibration generated at the center of the pump chamber 45 resonates with pressure vibration that has been generated at the center of the pump chamber 45, propagated toward and reflected by the outer peripheral portion, and returned to the central portion of the pump chamber 45.

When the piezoelectric actuator 37 of the piezoelectric blower 100 is driven at a high frequency, a pressure wave is generated in the pump chamber 45. The pressure wave generated in the pump chamber 45 propagates through the pump chamber 45, and is reflected by the side surface of the pump chamber 45 (the inner surface of the side wall plate 31) at both sides. In the piezoelectric blower 100, the phase of the pressure wave reflected by the left side surface of the pump chamber 45 matches the phase of the pressure wave reflected by the right side surface of the pump chamber 45.

Therefore, the pressure wave reflected by the left side surface of the pump chamber 45 and the pressure wave reflected by the right side surface of the pump chamber 45 enhance each other. As a result, a large pressure wave is outputted from the ejection holes 41 and the suction holes 93 and 96. Accordingly, the pump characteristics of the piezoelectric blower 100 can be improved.

The flow of air while the pump unit 13 is in operation will now be described.

Figure 5:
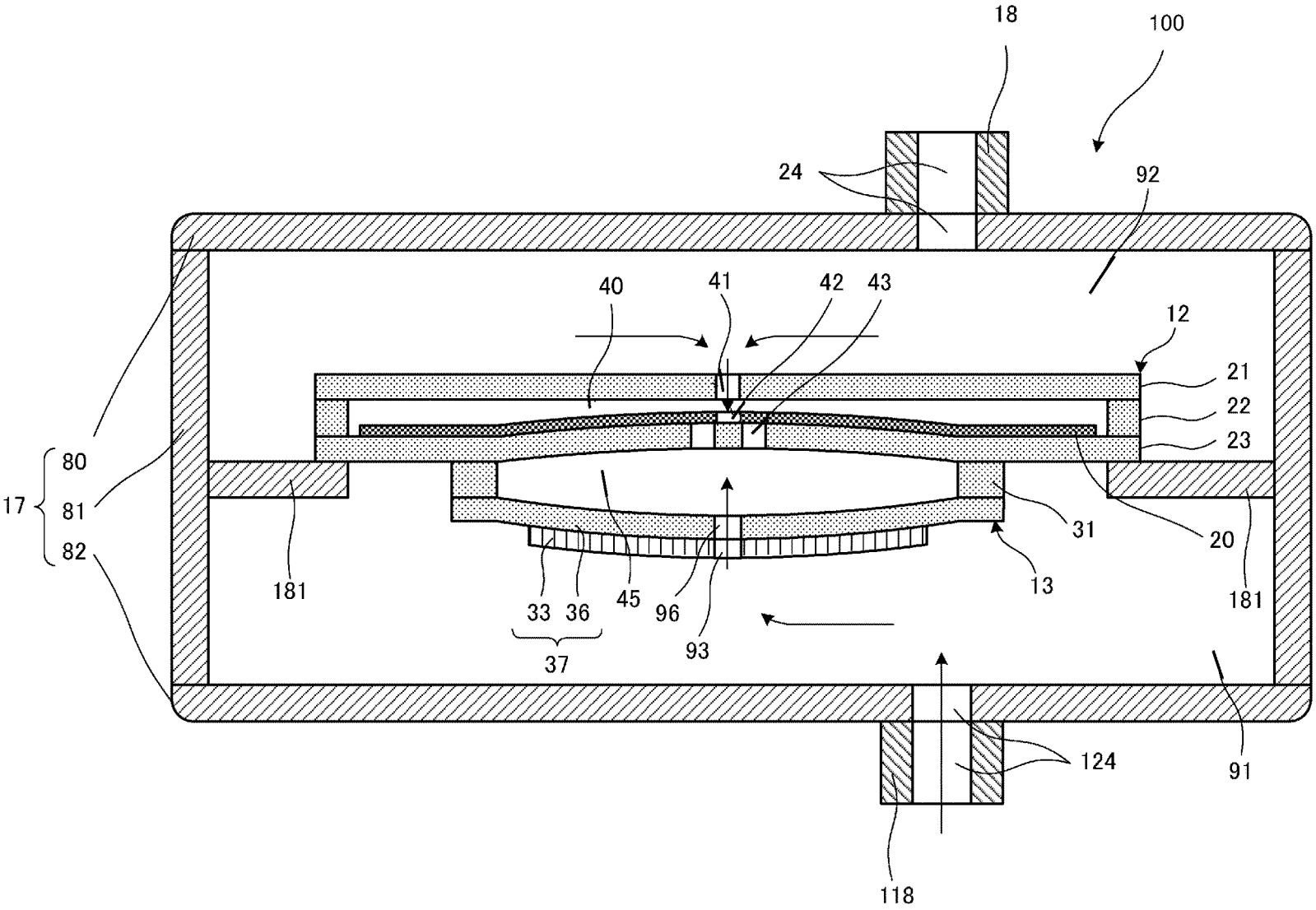
FIG. 5 is a sectional view of the piezoelectric blower 100 illustrated in FIG. 1 taken along line S-S when the piezoelectric blower 100 is subjected to resonant driving at a frequency of a first-order vibration mode for a blower body.
Figure 6:
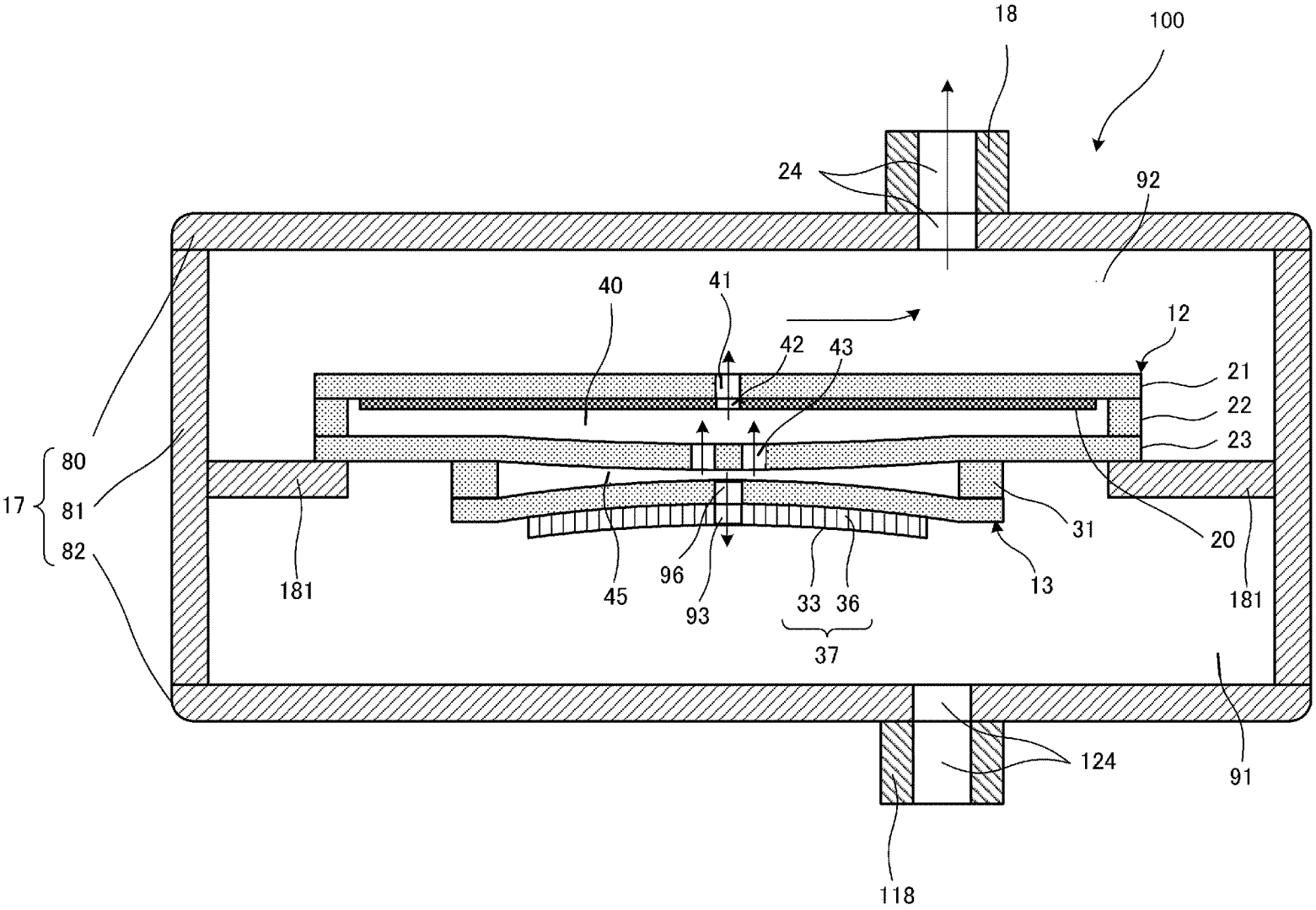
FIG. 6 is also a sectional view of the piezoelectric blower 100 illustrated in FIG. 1 taken along line S-S when the piezoelectric blower 100 is subjected to resonant driving at the frequency of the first-order vibration mode for the blower body.

FIGS. 5 and 6 are sectional views of the piezoelectric blower 100 illustrated in FIG. 1 taken along line S-S when the piezoelectric blower 100 is subjected to resonant driving at a frequency of a first-order vibration mode for the blower body. FIG. 5 shows the state in which the volume of the pump chamber is increased. FIG. 6 shows the state in which the volume of the pump chamber is reduced. The arrows in FIGS. 5 and 6 indicate the flow of air.

When the controller 14 applies an alternating driving voltage across the electrodes on both principal surfaces of the piezoelectric element 33 in the state illustrated in FIG. 2, the piezoelectric element 33 expands and contracts, thereby generating a concentric bending vibration of the vibrating plate 36. The vibration of the vibrating plate 36 is transmitted to the upper plate 23, so that a concentric bending vibration of the upper plate 23 is generated in response to the bending vibration of the vibrating plate 36. Accordingly, as illustrated in FIGS. 5 and 6, the piezoelectric actuator 37 is bent so as to periodically change the volume of the pump chamber 45.

When the vibrating plate 36 is bent in a direction away from the pump chamber 45 as illustrated in FIG. 5, the pressure in the pump chamber 45 decreases, and the film 20 is pulled toward the upper plate 23 and comes into contact with the upper plate 23 in the valve chamber 40. Accordingly, the communication holes 43 are blocked and the flow of air from the valve chamber 40 to the communication holes 43 is stopped. Also, outside air is sucked into the pump chamber 45 through the suction holes 93 and 96.

When the vibrating plate 36 is bent in a direction toward the pump chamber 45 as illustrated in FIG. 6, the pressure in the pump chamber 45 increases, and air is ejected into the valve chamber 40 through the communication holes 43. The ejected air pushes the film 20 toward the cover plate 21 so that the film 20 comes into contact with the cover plate 21.

Accordingly, the communication holes 43 are uncovered, and air flows into the valve chamber 40 through the communication holes 43. The air in the valve chamber 40 is ejected into the vent passage 92 through the ejection holes 41 in the valve unit 12. The air ejected into the vent passage 92 is discharged to the outside of the outer housing 17 through the outlet 24. The air in the pump chamber 45 is also ejected into the vent passage 91 through the suction holes 93 and 96.

As described above, the bending vibration of the upper plate 23 is generated in response to the bending vibration of the vibrating plate 36. Accordingly, when the film 20 is pulled toward the bottom surface of the valve chamber 40, the moving distance and moving time of the film 20 are reduced. This enables the film 20 to follow the variation in air pressure, and increases the responsivity of the valve unit 12.

In the above-described structure, when the piezoelectric actuator 37 is driven at a predetermined frequency, a pressure wave is outputted to the vent passage 92 through the ejection holes 41. The pressure wave outputted through the ejection holes 41 propagates through the vent passage 92 and is reflected by the inner wall surface of the outer housing 17.

Similarly, when the piezoelectric actuator 37 is driven at a predetermined frequency, a pressure wave is outputted to the vent passage 91 through the suction holes 93 and 96. The pressure wave outputted through the suction holes 93 and 96 propagates through the vent passage 91 and is reflected by the inner wall surface of the outer housing 17. The predetermined frequency is a frequency at which the pressure waves have antinodes in the vent passages 91 and 92 (for example, 10 kHz or higher). When the frequency is high, the pressure waves have a short wave length, and therefore have antinodes in the vent passages 91 and 92.

In the piezoelectric blower 100, the inlet 124 and the outlet 24 are both displaced from the central axis C of the pump chamber 45. Therefore, most of the pressure wave reflected at the right end 92B of the vent passage 92 is discharged to the outside of the outer housing 17 through the outlet 24. Accordingly, the pressure wave reflected at the left end 92A of the vent passage 92 and the pressure wave reflected at the right end 92B of the vent passage 92 do not greatly enhance each other in the vent passage 92. As a result, a large pressure amplitude does not occur in the vent passage 92. In other words, a large energy loss does not occur in the vent passage 92.

Similarly, in the piezoelectric blower 100, most of the pressure wave reflected at the right end 91B of the vent passage 91 is discharged to the outside of the outer housing 17 through the inlet 124. Accordingly, the pressure wave reflected at the left end 91A of the vent passage 91 and the pressure wave reflected at the right end 91B of the vent passage 91 do not greatly enhance each other in the vent passage 91. As a result, a large pressure amplitude does not occur in the vent passage 91. In other words, a large energy loss does not occur in the vent passage 91.

Therefore, in the piezoelectric blower 100, the degradation of the pump characteristics (for example, discharge pressure and discharge flow rate) can be inhibited.

Although the inlet 124 and the outlet 24 are both displaced from the central axis C of the pump chamber 45 in the piezoelectric blower 100, the arrangement thereof is not limited to this. For example, only one of the inlet 124 and the outlet 24 may be displaced from the central axis C of the pump chamber 45.

A piezoelectric blower 200 according to a second embodiment of the present disclosure will now be described.

Figure 7:
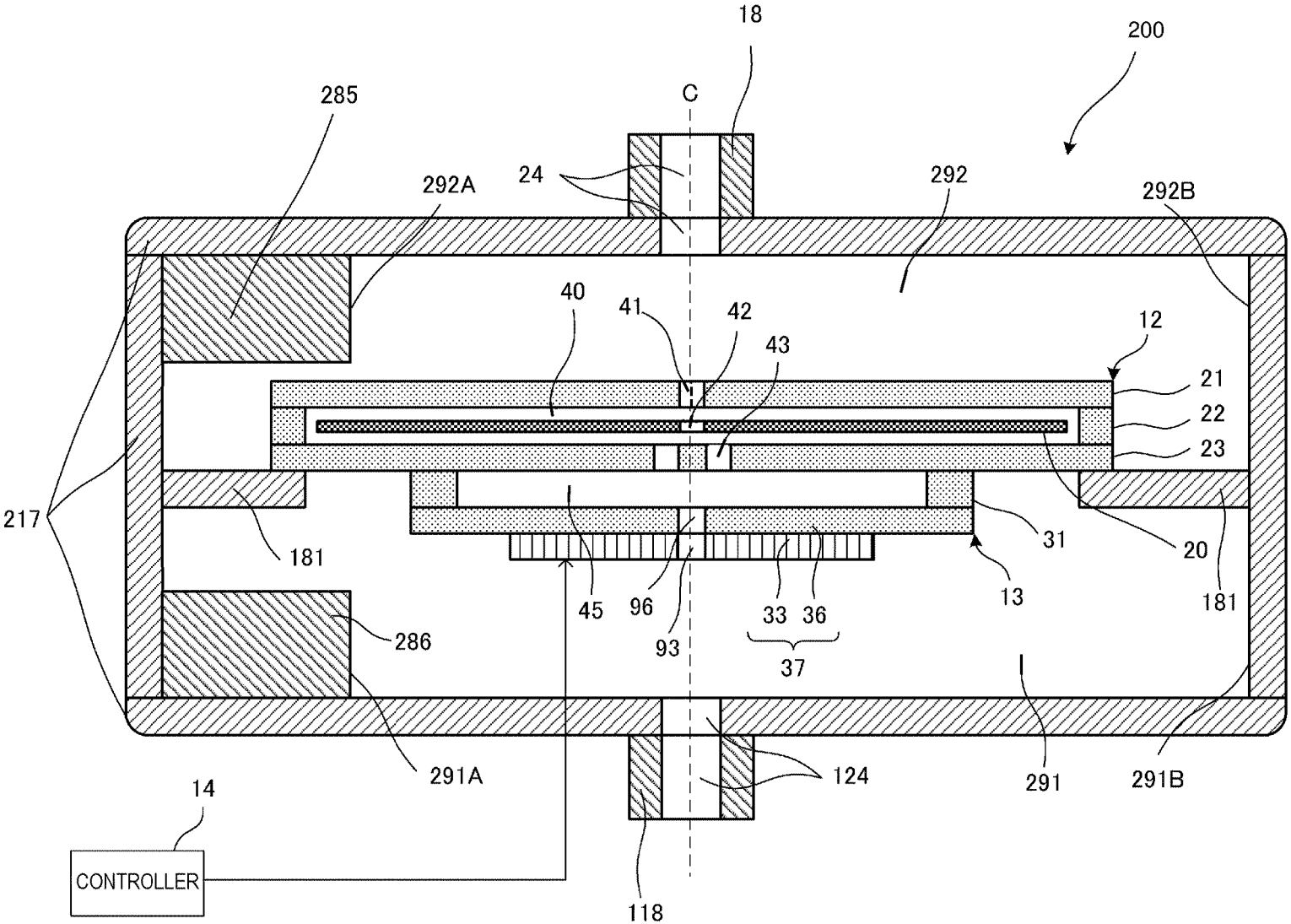
FIG. 7 is a sectional view of a piezoelectric blower 200 according to a second embodiment of the present disclosure.

FIG. 7 is a sectional view of the piezoelectric blower 200 according to the second embodiment of the present disclosure.

The piezoelectric blower 200 differs from the piezoelectric blower 100 according to the first embodiment in the shape of an outer housing 217. The outer housing 217 differs from the outer housing 17 of the piezoelectric blower 100 in the positions of the outlet 24 and the inlet 124 and in that projections 285 and 286 are provided. Other structures are the same as those of the piezoelectric blower 100 according to the first embodiment, and description thereof is thus omitted.

The outer housing 217 covers the valve unit 12 and the pump unit 13 with a gap between the outer housing 217 and each of the valve unit 12 and the pump unit 13. Thus, vent passages 291 and 292 are formed between the outer housing 217 and the valve unit 12 and between the outer housing 217 and the pump unit 13. The distance from the central axis C to a left end 291A of the vent passage 291 (the left inner wall surface of the outer housing 217) differs from the distance from the central axis C to a right end 291B of the vent passage 291 (the right inner wall surface of the outer housing 217). The left end 291A corresponds to an example of a "first end" according to the present disclosure. The right end 291B corresponds to an example of a "second end" according to the present disclosure.

The distance from the central axis C to a left end 292A of the vent passage 292 (the left inner wall surface of the outer housing 217) differs from the distance from the central axis C to a right end 292B of the vent passage 292 (the right inner wall surface of the outer housing 217). The inlet 124 communicates with the vent passage 291. The outlet 24 communicates with the vent passage 92. The inlet 124 and the outlet 24 are both disposed on the central axis C of the pump chamber 45. The left end 292A corresponds to an example of a "first end" according to the present disclosure. The right end 292B corresponds to an example of a "second end" according to the present disclosure.

In the piezoelectric blower 200, the phase of the pressure wave reflected at the left end 292A of the vent passage 292 is shifted from the phase of the pressure wave reflected at the right end 292B of the vent passage 292. Therefore, the pressure wave reflected at the left end 292A of the vent passage 292 and the pressure wave reflected at the right end 292B of the vent passage 292 do not greatly enhance each other in the vent passage 292. As a result, a large pressure amplitude does not occur in the vent passage 292. In other words, a large energy loss does not occur in the vent passage 292.

Similarly, in the piezoelectric blower 200, the phase of the pressure wave reflected at the left end 291A of the vent passage 291 is shifted from the phase of the pressure wave reflected at the right end 291B of the vent passage 291. Therefore, the pressure wave reflected at the left end 291A of the vent passage 291 and the pressure wave reflected at the right end 291B of the vent passage 291 do not greatly enhance each other in the vent passage 292. As a result, a large pressure amplitude does not occur in the vent passage 291. In other words, a large energy loss does not occur in the vent passage 291.

Therefore, in the piezoelectric blower 200, the degradation of the pump characteristics (for example, discharge pressure and discharge flow rate) can be inhibited.

Although the piezoelectric blower 200 includes both the projection 285 and the projection 286, the piezoelectric blower 200 is not limited to this. For example, the piezoelectric blower 200 may instead include only one of the projections 285 and 286.

Although the inlet 124 and the outlet 24 are respectively formed in the bottom surface and the top surface of the outer housing 217 in the piezoelectric blower 200, the arrangement thereof is not limited to this. As in a piezoelectric blower 300 illustrated in FIGS. 8 and 9 described below, the arrangement may instead be such that at least one of the inlet 124 and the outlet 24 is formed in a side surface of the outer housing 217.

A piezoelectric blower 300 according to a third embodiment of the present disclosure will now be described.

Figure 8:
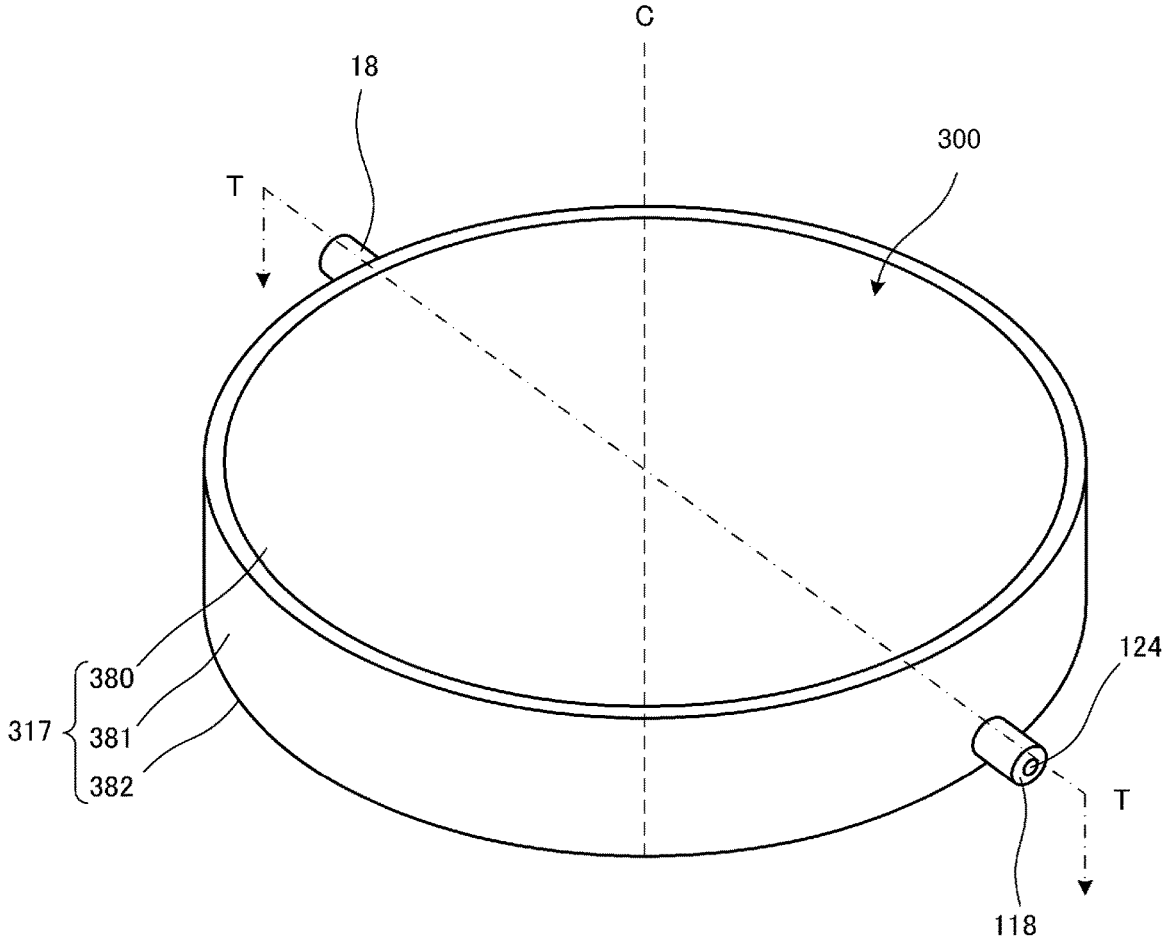
FIG. 8 is an external perspective view of a piezoelectric blower 300 according to a third embodiment of the present disclosure.
Figure 9:
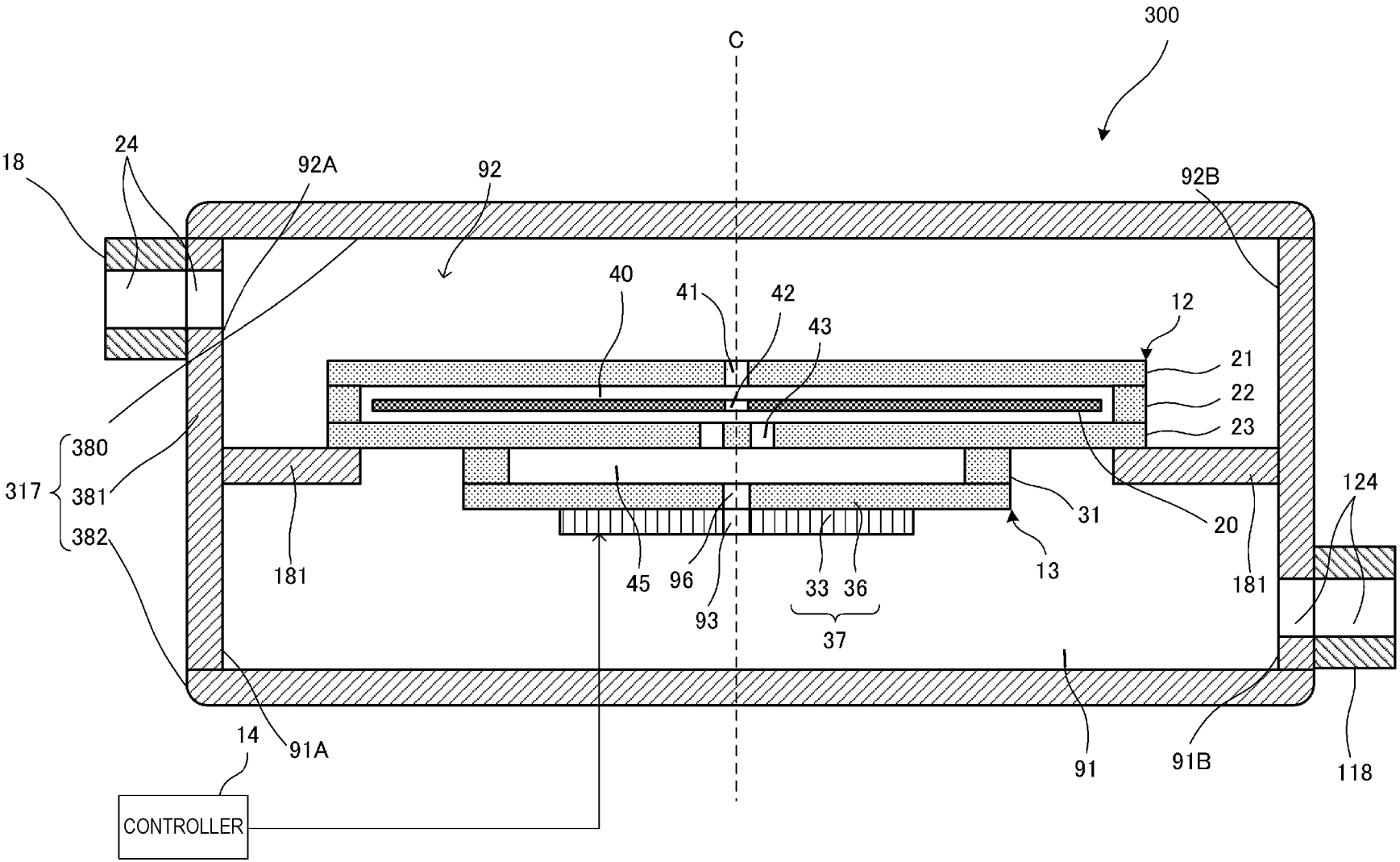
FIG. 9 is a sectional view of the piezoelectric blower 300 illustrated in FIG. 8 taken along line T-T.

FIG. 8 is an external perspective view of the piezoelectric blower 300 according to the third embodiment of the present disclosure. FIG. 9 is a sectional view of the piezoelectric blower 300 illustrated in FIG. 8 taken along line T-T.

The piezoelectric blower 300 differs from the piezoelectric blower 100 according to the first embodiment in that the nozzles 18 and 118 (that is, the inlet 124 and the outlet 24) are both formed in a side surface of an outer housing 317. Other structures are the same as those of the piezoelectric blower 100 according to the first embodiment, and the description thereof is thus omitted.

The outer housing 317 includes a side plate 381 having both the inlet 124 and the outlet 24. A top plate 380 and a bottom plate 382 have neither the inlet 124 nor the outlet 24. Therefore, when tubes are attached to the inlet 124 and the outlet 24 of the piezoelectric blower 300, the tubes are attached to the side surface of the outer housing 317. Thus, the height of the piezoelectric blower 300 can be reduced.

The nozzles 118 and 18 are disposed on line T-T, which is orthogonal to the central axis C of the pump chamber 45. Accordingly, no moment is generated when a tube is attached to or removed from the nozzle 118 or the nozzle 18 of the piezoelectric blower 300, and therefore the outer housing 317 does not rotate. Thus, the tube can be easily attached to and removed from the piezoelectric blower 300.

In addition, in the piezoelectric blower 300, the outlet 24 and the inlet 124 are both formed in the side surface of the outer housing 317. Since the outlet 24 is provided at the left end 92A of the vent passage 92, the phase of the pressure wave reflected at the left end 92A of the vent passage 92, that is, at the outer end of the outlet 24, is reversed. Accordingly, the pressure wave reflected at the right end 92B of the vent passage 92 and the pressure wave reflected at the left end 92A of the vent passage 92 have opposite phases, and therefore cancel each other. As a result, the pressure amplitude in the vent passage 92 is smaller than that in the piezoelectric blower 100. In other words, the energy loss in the vent passage 92 is smaller than that in the piezoelectric blower 100.

Similarly, since the inlet 124 is provided at the right end 91B of the vent passage 91, the phase of the pressure wave reflected at the right end 91B of the vent passage 91, that is, at the outer end of the inlet 124, is reversed. Accordingly, the pressure wave reflected at the left end 91A of the vent passage 91 and the pressure wave reflected at the right end 91B of the vent passage 91 have opposite phases, and therefore cancel each other. As a result, the pressure amplitude in the vent passage 91 is smaller than that in the piezoelectric blower 100. In other words, the energy loss in the vent passage 91 is smaller than that in the piezoelectric blower 100.

Therefore, in the piezoelectric blower 300, the degradation of the pump characteristics (for example, discharge pressure and discharge flow rate) can be further inhibited than in the piezoelectric blower 100.

Although the inlet 124 and the outlet 24 are both formed in the side surface of the outer housing 317 in the piezoelectric blower 300, the arrangement thereof is not limited to this. The arrangement may instead be such that at least one of the inlet 124 and the outlet 24 is formed in the side surface of the outer housing 317.

A piezoelectric blower 400 according to a fourth embodiment of the present disclosure will now be described.

Figure 10:
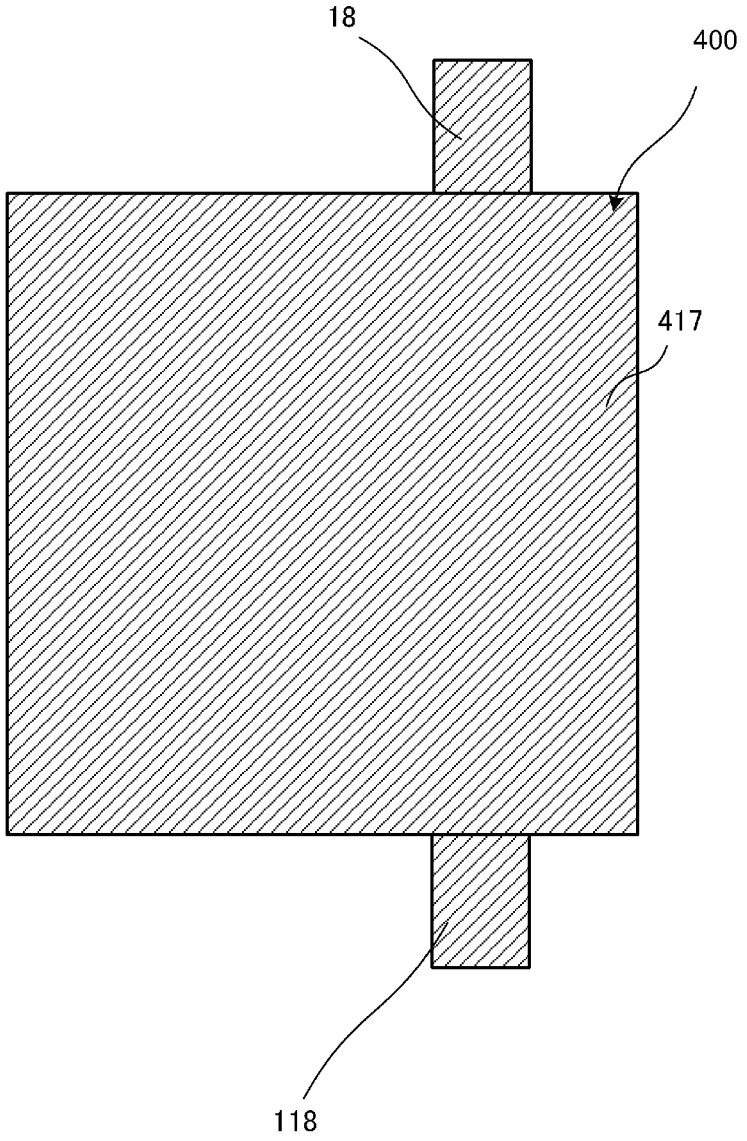
FIG. 10 is a plan view of a piezoelectric blower 400 according to a fourth embodiment of the present disclosure.

FIG. 10 is a plan view of the piezoelectric blower 400 according to the fourth embodiment of the present disclosure.

The piezoelectric blower 400 differs from the piezoelectric blower 100 according to the first embodiment in the positions of the nozzles 18 and 118 (that is, the positions of the inlet 124 and the outlet 24) and the shape of an outer housing 417. The outer housing 417 is rectangular parallelepiped-shaped. Other structures are the same as those of the piezoelectric blower 100 according to the first embodiment, and the description thereof is thus omitted.

In the piezoelectric blower 400, the nozzles 118 and 18 are arranged so as to oppose each other. Therefore, forces generated when two tubes are simultaneously attached to or removed from the nozzles 118 and 18 of the piezoelectric blower 400 cancel each other, and therefore the outer housing 417 is not displaced. Thus, the tubes can be more easily attached to and removed from the piezoelectric blower 400.

A piezoelectric blower 500 according to a fifth embodiment of the present disclosure will now be described.

Figure 11:
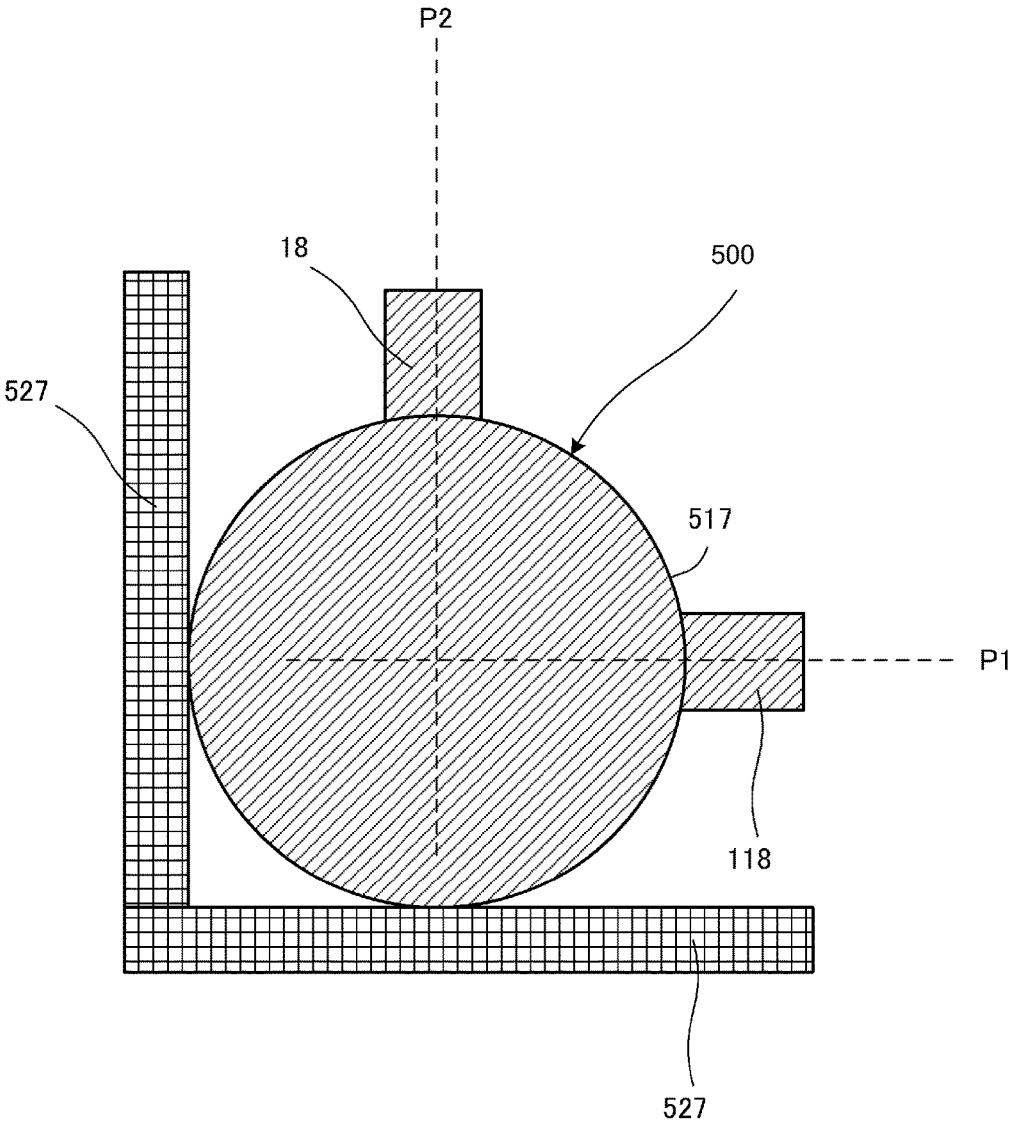
FIG. 11 is a plan view of a piezoelectric blower 500 according to a fifth embodiment of the present disclosure.

FIG. 11 is a plan view of the piezoelectric blower 500 according to the fifth embodiment of the present disclosure.

The piezoelectric blower 500 differs from the piezoelectric blower 100 according to the first embodiment in the positions of the nozzles 18 and 118 (that is, the positions of the inlet 124 and the outlet 24). Two wall portions 527 are, for example, portions of a housing of an electronic device in which the piezoelectric blower 500 is mounted. Other structures are the same as those of the piezoelectric blower 100 according to the first embodiment, and the description thereof is thus omitted.

In the piezoelectric blower 500, the angle between a central axis P1 of the nozzle 118 and a central axis P2 of the nozzle 18 is 90 degrees. Therefore, when a tube is attached to the nozzle 118 or the nozzle 18 while the piezoelectric blower 500 is disposed at the corner between the two wall portions 527, the outer housing 517 is supported by the two wall portions 527. Thus, the tube can be more easily attached to the piezoelectric blower 500.

A piezoelectric blower 600 according to a sixth embodiment of the present disclosure will now be described.

Figure 12:
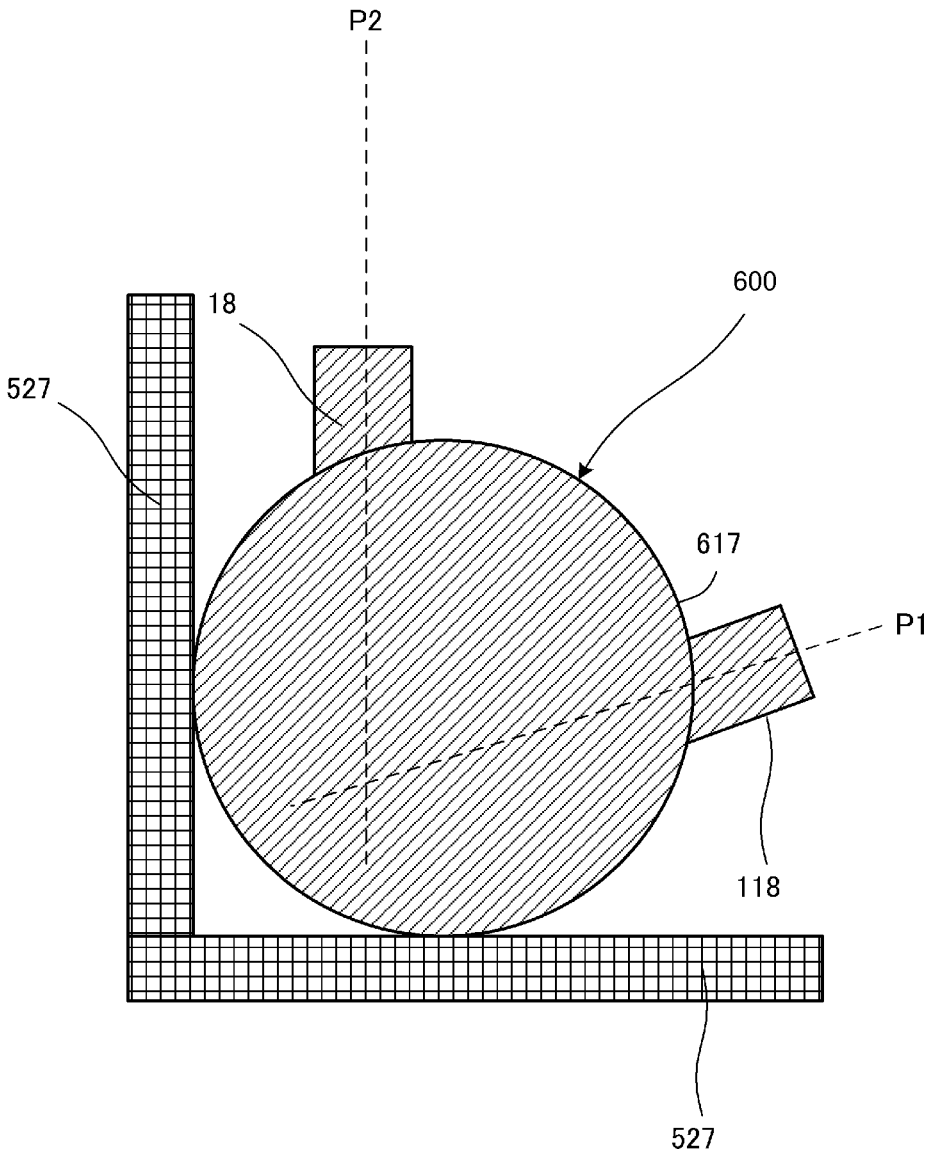
FIG. 12 is a plan view of a piezoelectric blower 600 according to a sixth embodiment of the present disclosure.

FIG. 12 is a plan view of the piezoelectric blower 600 according to the sixth embodiment of the present disclosure.

The piezoelectric blower 600 differs from the piezoelectric blower 100 according to the first embodiment in the positions of the nozzles 18 and 118 (that is, the positions of the inlet 124 and the outlet 24). Other structures are the same as those of the piezoelectric blower 100 according to the first embodiment, and the description thereof is thus omitted.

In the piezoelectric blower 600, the angle between the central axis P1 of the nozzle 118 and the central axis P2 of the nozzle 18 is less than or equal to 90 degrees. Therefore, when a tube is attached to the nozzle 118 or the nozzle 18 while the piezoelectric blower 600 is disposed at the corner between the two wall portions 527, the outer housing 617 is supported by the two wall portions 527. Thus, in the piezoelectric blower 600, the tube can be more easily attached.

A piezoelectric blower 700 according to a seventh embodiment of the present disclosure will now be described.

Figure 13:
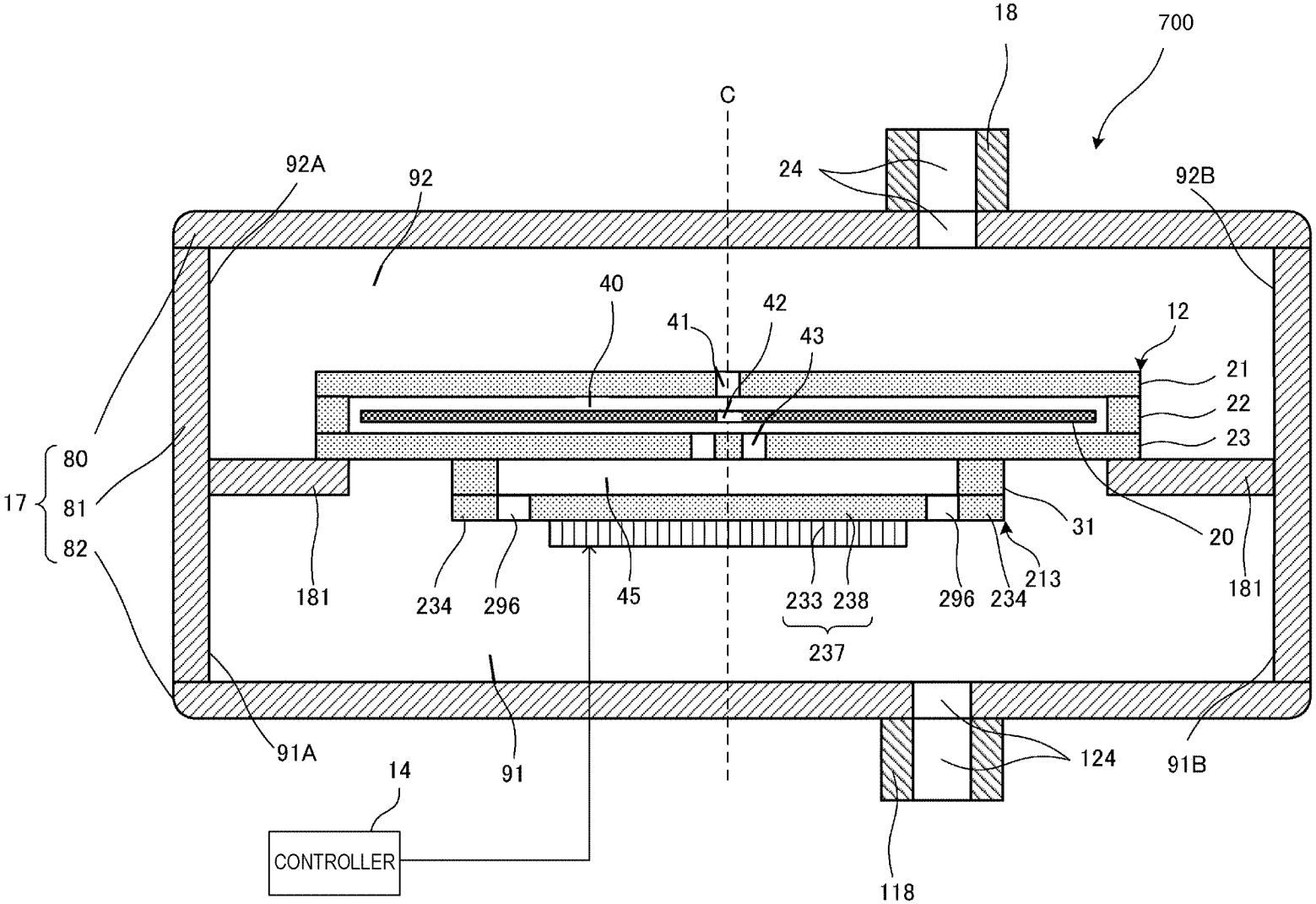
FIG. 13 is a sectional view of a piezoelectric blower 700 according to a seventh embodiment of the present disclosure.
Figure 14:
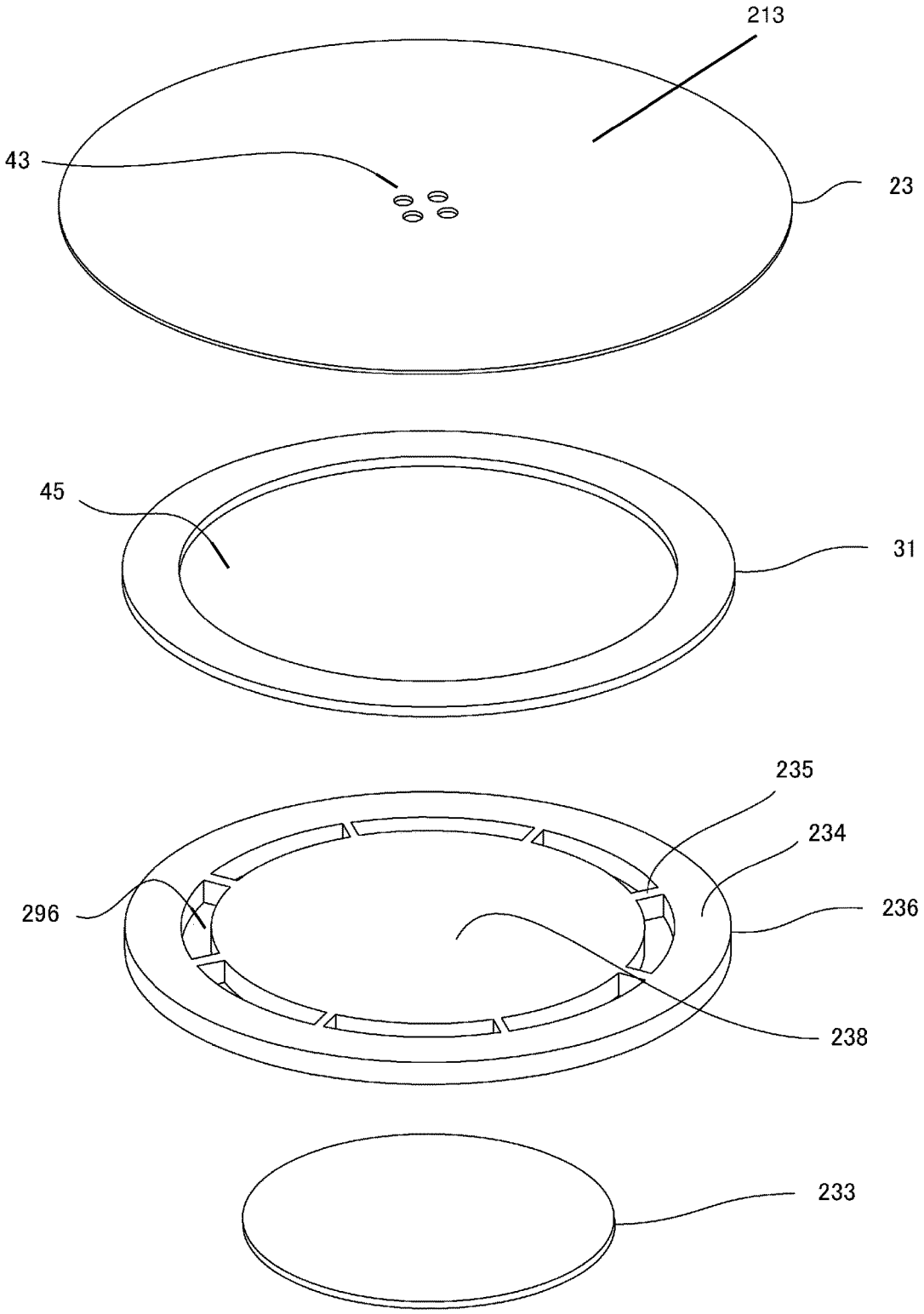
FIG. 14 is an exploded perspective view of a pump unit 213 illustrated in FIG. 13.

FIG. 13 is a sectional view of the piezoelectric blower 700 according to the seventh embodiment of the present disclosure. FIG. 14 is an exploded perspective view of a pump unit 213 illustrated in FIG. 13.

The piezoelectric blower 700 differs from the piezoelectric blower 100 according to the first embodiment in that a vibrating plate 236 and a piezoelectric element 233 are provided. Other structures are the same as those of the piezoelectric blower 100 according to the first embodiment, and the description thereof is thus omitted.

The vibrating plate 236 includes a frame portion 234, a plurality of connecting portions 235, and a vibrating portion 238. The frame portion 234 is annular-shaped. The vibrating portion 238 is disc-shaped, and is arranged so that gaps are provided between the vibrating portion 238 and the frame portion 234. The connecting portions 235 are disposed between the frame portion 234 and the vibrating portion 238 so as to connect the vibrating portion 238 to the frame portion 234.

Thus, the vibrating portion 238 is supported in midair by the connecting portions 235, and is movable in the thickness direction, that is, in the up-down direction. The gaps between the frame portion 234 and the vibrating portion 238 serve as eight suction holes 296. The eight suction holes 296 are symmetrical about the central axis C of the pump chamber 45.

The piezoelectric element 233 differs from the piezoelectric element 33 in that it does not have the suction hole 93. The piezoelectric element 233 is disc-shaped. The top surface of the piezoelectric element 233 is attached to the bottom surface of the vibrating portion 238.

In the above-described structure, when the piezoelectric element 233 receives a driving voltage, the piezoelectric element 233 expands and contracts in the planar direction, and a concentric bending vibration of the vibrating portion 238 is generated. The piezoelectric element 233 and the vibrating portion 238 constitute a piezoelectric actuator 37 and vibrate together.

Also in the piezoelectric blower 700, the inlet 124 and the outlet 24 are both displaced from the central axis C of the pump chamber 45. Therefore, also in the piezoelectric blower 700, the degradation of the pump characteristics (for example, discharge pressure and discharge flow rate) can be inhibited as in the piezoelectric blower 100.

Figure 19:
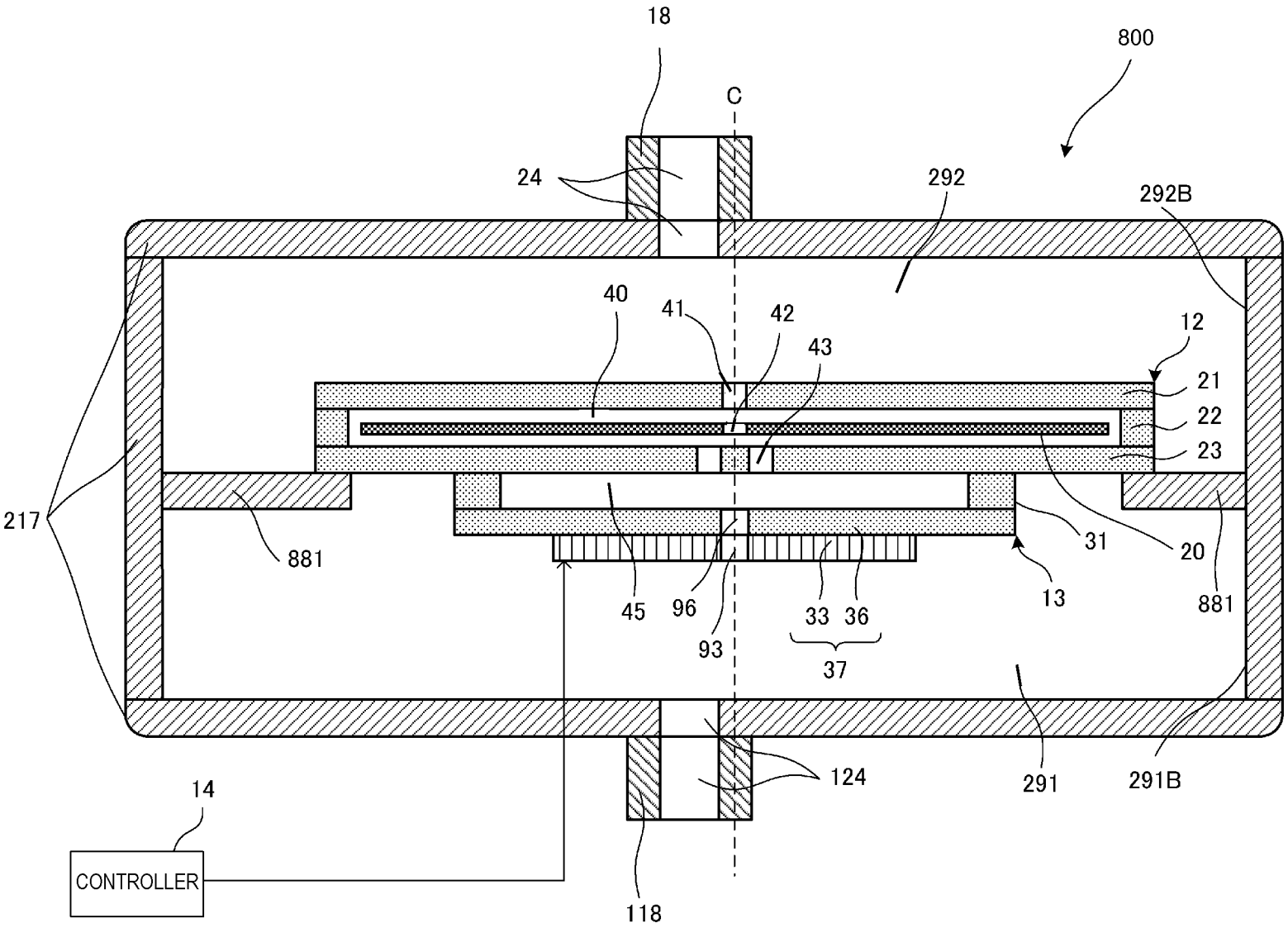
FIG. 19 is a sectional view of a piezoelectric blower 800 according to an eighth embodiment of the present disclosure.
Figure 20:
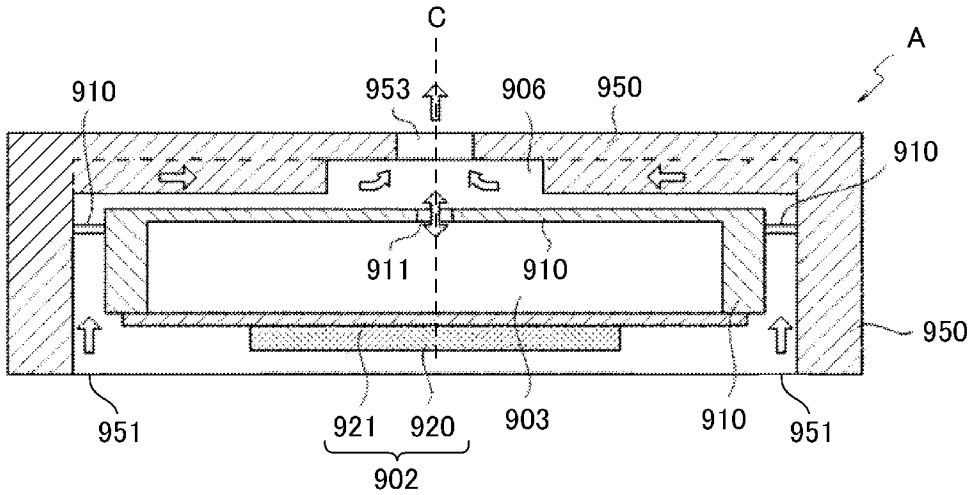
FIG. 20 is a sectional view of a piezoelectric microblower according to Patent Document 1.

A piezoelectric blower 800 according to an eighth embodiment of the present disclosure will now be described. FIG. 19 is a sectional view of the piezoelectric blower 800 according to the eighth embodiment of the present disclosure.

The piezoelectric blower 800 is a modification of the piezoelectric blower 200 according to the second embodiment illustrated in FIG. 7. The piezoelectric blower 800 differs from the piezoelectric blower 200 in the length of a receiving portion 881 and the arrangement of the valve unit 12 and the pump unit 13. Other structures are the same as those of the piezoelectric blower 200 according to the second embodiment, and the description thereof is thus omitted.

As illustrated in FIG. 19, also in the piezoelectric blower 800, the inlet 124 and the outlet 24 are both displaced from the central axis C of the pump chamber 45. Therefore, also in the piezoelectric blower 800, the degradation of the pump characteristics (for example, discharge pressure and discharge flow rate) can be inhibited as in the piezoelectric blower 100.

Other Embodiments

Although air is used as the gas in the above-described embodiments, the gas is not limited to this. The gas may instead be gas other than air.

In addition, although the piezoelectric element 33 is used as the drive source for the blower in the above-described embodiments, the drive source is not limited to this. For example, the blower may instead be electromagnetically driven.

In addition, although the piezoelectric element 33 is made of a lead zirconate titanate ceramic in the above-described embodiments, the material thereof is not limited to this. For example, a lead-free piezoelectric ceramic material, such as a potassium sodium niobate ceramic or an alkali niobate ceramic, may instead be used.

In addition, although a unimorph piezoelectric vibrator is used in the above-described embodiment, the piezoelectric vibrator is not limited to this. For example, a bimorph piezoelectric vibrator in which the piezoelectric element 33 is provided on each surface of the vibrating plate 36 may instead be used.

In addition, although the piezoelectric elements 33 and 233 are disc-shaped in the above-described embodiments, the shape thereof is not limited to this. For example, the piezoelectric elements may instead be elliptical or polygonal ring-shaped. Alternatively, the piezoelectric elements may be polygonal plate-shaped or elliptical plate-shaped.

In addition, although the vibrating plate 36 and the upper plate 23 are disc-shaped in the above-described embodiments, the shape thereof is not limited to this. For example, the vibrating plate 36 and the upper plate 23 may instead be rectangular plate-shaped, polygonal plate-shaped, or elliptical plate-shaped.

In the piezoelectric blower 100, as illustrated in FIG. 3, a single suction hole 96 that is point-symmetric about the central axis C of the pump chamber 45 is formed in the vibrating plate 36. In the piezoelectric blower 700, as illustrated in FIG. 14, eight suction holes 296 that are arranged point-symmetric about the central axis C of the pump chamber 45 in an octagonal pattern are formed in the vibrating plate 236. However, the arrangement of the suction holes is not limited to this. In practice, a plurality of suction holes may be arranged symmetric about the central axis C of the pump chamber 45 in the following manner.

Figure 15:
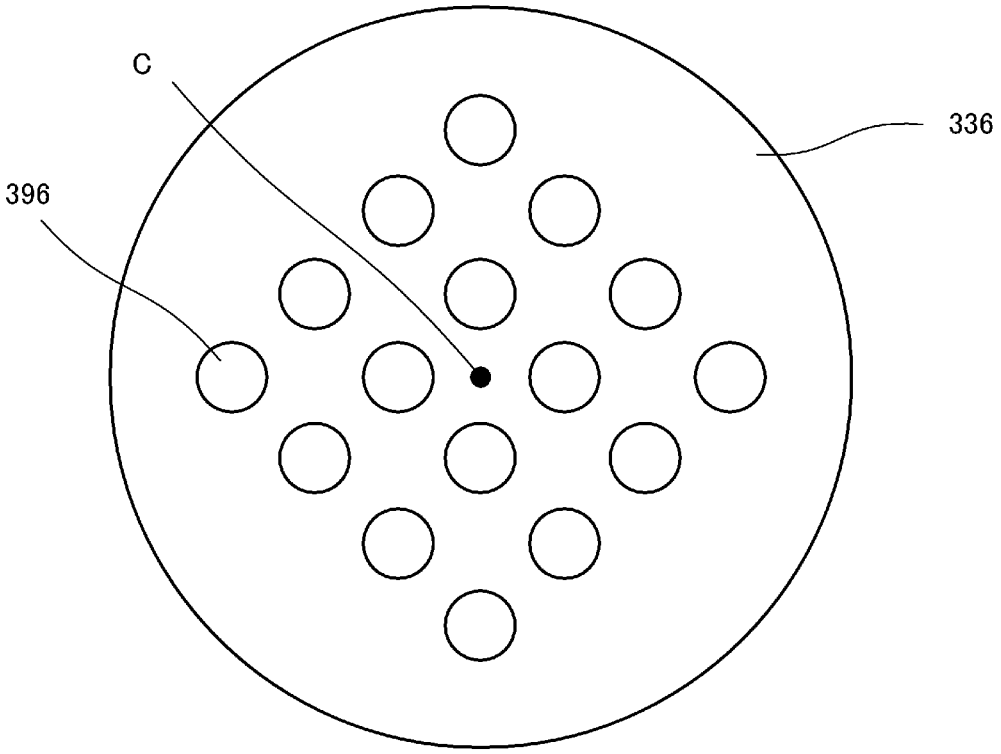
FIG. 15 is a plan view of a vibrating plate 336, which is a modification of a vibrating plate 36 illustrated in FIG. 2.
Figure 16:
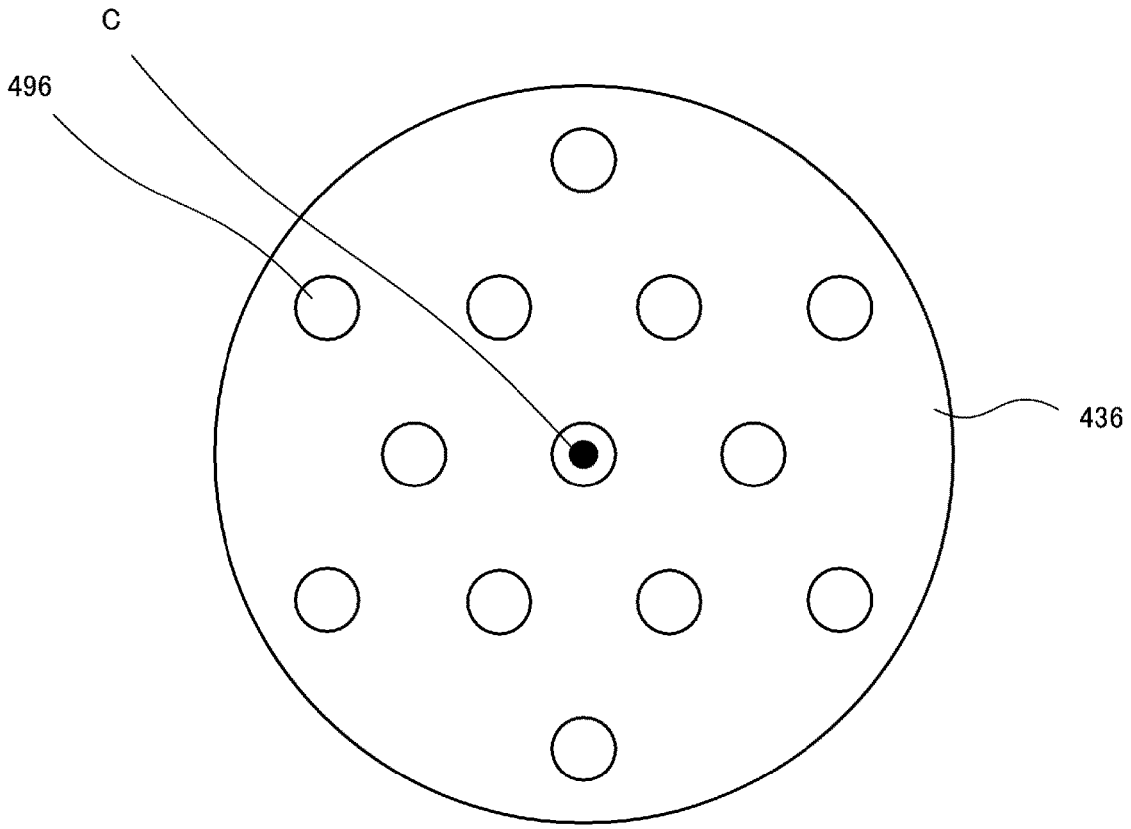
FIG. 16 is a plan view of a vibrating plate 436, which is another modification of the vibrating plate 36 illustrated in FIG. 2.
Figure 17:
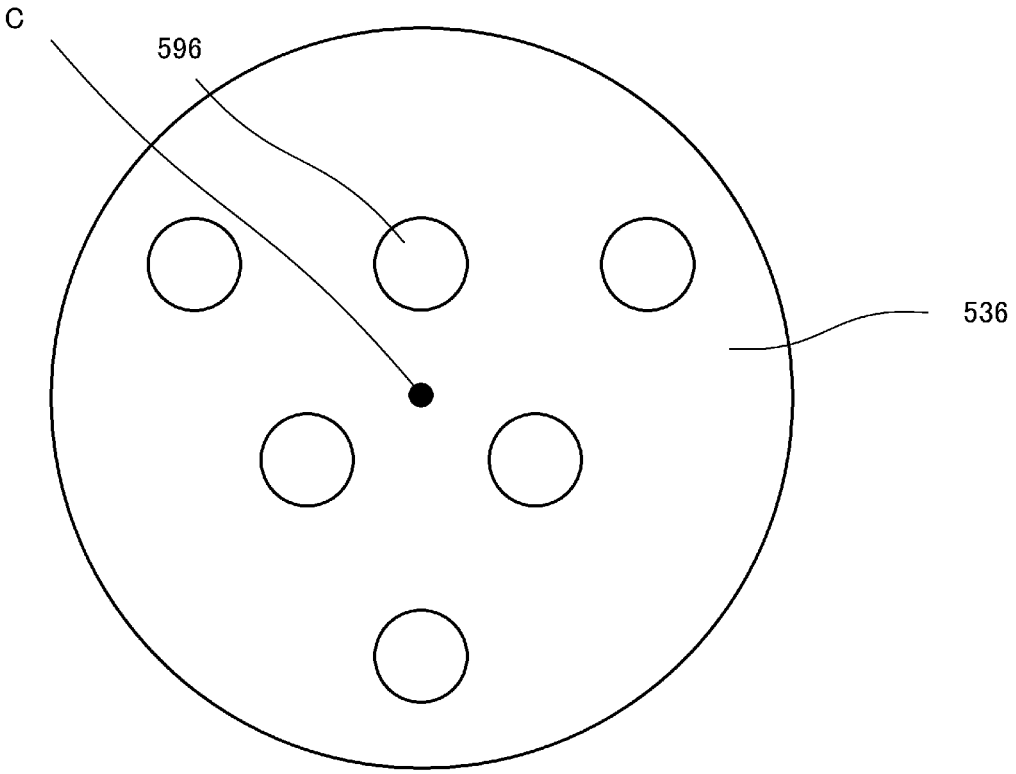
FIG. 17 is a plan view of a vibrating plate 536, which is another modification of the vibrating plate 36 illustrated in FIG. 2.
Figure 18:
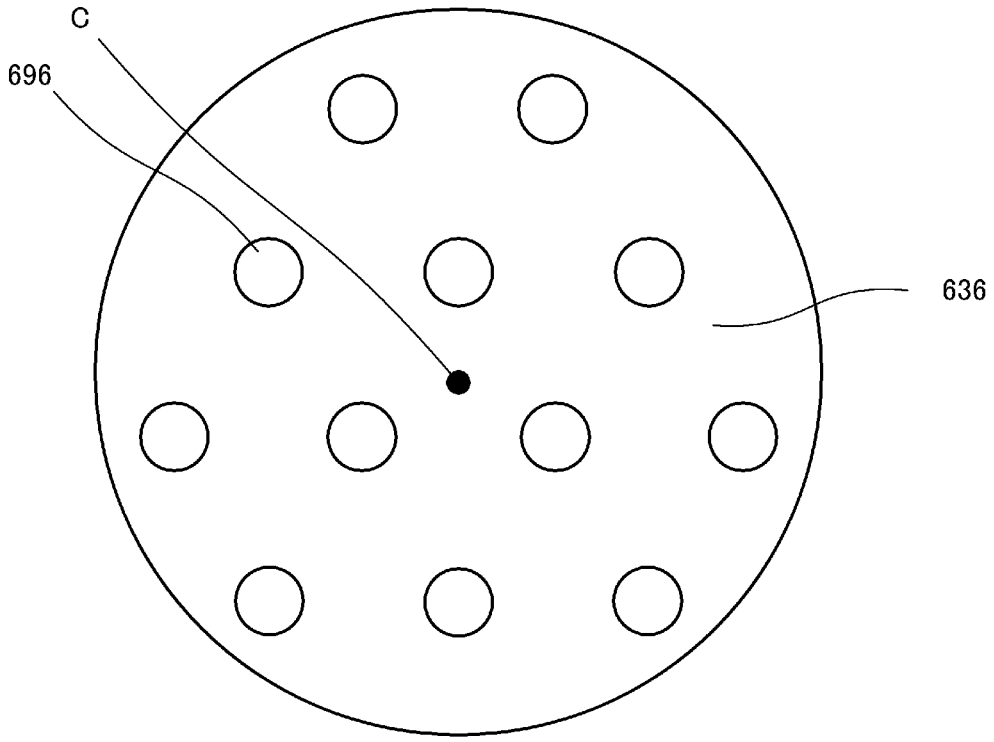
FIG. 18 is a plan view of a vibrating plate 636, which is another modification of the vibrating plate 36 illustrated in FIG. 2.

For example, as illustrated in FIG. 15, a plurality of suction holes 396 may be formed in a vibrating plate 336 so as to have 4-fold rotation symmetry about the central axis C of the pump chamber 45. As illustrated in FIG. 16, a plurality of suction holes 496 may be formed in a vibrating plate 436 so as to have 6-fold rotation symmetry about the central axis C of the pump chamber 45. As illustrated in FIG. 17, a plurality of suction holes 596 may be formed in a vibrating plate 536 so as to have 3-fold rotation symmetry about the central axis C of the pump chamber 45. As illustrated in FIG. 18, a plurality of suction holes 696 may be formed in a vibrating plate 636 so as to have 3-fold rotation symmetry about the central axis C of the pump chamber 45. Similar to the suction holes, a plurality of ejection holes, a plurality of film holes, and a plurality of communication holes may also be arranged point-symmetric about the central axis C of the pump chamber 45 as illustrated in FIGS. 15 to 18.

Although the vent passages 91 and 92 are substantially cylindrical in the above-described embodiments, the shape thereof is not limited to this. For example, the vent passages may instead be prism shaped. In addition, as in the vent passages 291 and 292 illustrated in FIG. 7, the projections 285 and 286 may be formed.

In addition, although the piezoelectric blowers 100 to 700 are subjected to resonant driving at a frequency of the first-order vibration mode in the above-described embodiments, the frequency is not limited to this. In practice, the piezoelectric blowers 100 to 700 may instead be subjected to resonant driving at a frequency of a vibration mode in which a plurality of vibration antinodes are provided, such as a third-order vibration mode.

In addition, although a concentric bending vibration of the upper plate 23 is generated in response to the bending vibration of the vibrating plate 36 in the above-described embodiment, the upper plate 23 is not limited to this. In practice, for example, only the bending vibration of the vibrating plate 36 may be generated, and it is not necessary that the bending vibration of the upper plate 23 be generated in response to the bending vibration of the vibrating plate 36.

Finally, it should be understood that the above-described embodiments are illustrative in all aspects and not restrictive. The scope of the present disclosure is defined not by the above-described embodiments but by the scope of the claims. Furthermore, the scope of the present disclosure includes the scope equivalent to the scope of the claims.

A piezoelectric micro-blower
12 valve unit
13 pump unit
14 controller
17 outer housing
18 nozzle
20 film
21 cover plate
22 side wall plate
23 upper plate
24 outlet
25 projection
26 cut portion
31 side wall plate
33 piezoelectric element
36 vibrating plate
37 piezoelectric actuator
38 side plate
40 valve chamber
41 ejection hole
42 film hole
43 communication hole
45 pump chamber
80 top plate
81 side plate
82 bottom plate
91, 92 vent passage
93, 96 suction hole
100, 200, 300, 400, 500, 600, 700 piezoelectric blower
118 nozzle
124 inlet
181 receiving portion
213 pump unit
217 outer housing
233 piezoelectric element
234 frame portion
235 connecting portion
236 vibrating plate
238 vibrating portion
285 projection
291, 292 vent passage
296 suction hole
317, 417, 517, 617 outer housing
336, 436, 536, 636 vibrating plate
380 top plate
381 side plate
382 bottom plate
396, 496, 596, 696 suction hole
527 wall portion
902 actuator
903 pump chamber
906 vent passage
910 pump housing
920 piezoelectric element
921 vibrating plate
950 outer housing
951 inlet
953 outlet

The invention claimed is:

1. A blower comprising:

a pump unit including:
a vibrating body,
a driving body vibrating the vibrating body,
a pump chamber inside the pump unit, and a plurality of vent holes through which the pump chamber communicates with an outside of the pump unit, the plurality of vent holes being symmetric about a central axis of the pump chamber; and an outer housing covering the pump unit with a gap between the outer housing and the pump unit, the outer housing comprising:
an upper wall,
a bottom wall, a side wall extending from the upper wall to the bottom wall, an inlet, and an outlet, wherein at least one of the inlet and the outlet is displaced from the central axis of the pump chamber, wherein at least one of the inlet and outlet is provided in the side wall of the outer housing, and wherein the pump unit is connected to the outer housing via an annular member that projects inward from the outer housing toward the central axis.

2. The blower according to claim 1, wherein the inlet and outlet are both provided in the side wall of the outer housing.

3. The blower according to claim 1, wherein the inlet and the outlet are both displaced from the central axis of the pump chamber.

4. The blower according to claim 1, wherein the inlet, the outlet, and at least one of the plurality of vent holes are not disposed on a straight line.

5. The blower according to claim 1, wherein:

a first vent passage is formed between the pump unit and the outer housing, the first vent passage being disposed on a first side of the pump unit, and a second vent passage is formed between the pump unit and the outer housing, the second vent passage being disposed on a second side of the pump unit.

6. The blower according to claim 5, wherein the first vent passage is disposed on a lower side of the pump unit and the second vent passage is disposed on an upper side of the pump unit.

7. The blower according to claim 5, wherein:

the inlet of the outer housing provides communication between the first vent passage and an outside of the outer housing, the outlet of the outer housing provides communication between the second vent passage and the outside of the outer housing, and the plurality of vent holes includes one or more suction holes that provide communication between the pump chamber and the first vent passage, and one or more ejection holes that provide communication between the pump chamber and the second vent passage.

8. The blower according to claim 1, wherein the pump unit further comprises a valve chamber inside the pump unit, and a film disposed in the valve chamber.

9. The blower according to claim 8, wherein:

a first vent passage is formed between the pump unit and the outer housing, the first vent passage being disposed on a first side of the pump unit, a second vent passage is formed between the pump unit and the outer housing, the second vent passage being disposed on a second side of the pump unit, the inlet of the outer housing provides communication between the first vent passage and an outside of the outer housing, the outlet of the outer housing provides communication between the second vent passage and the outside of the outer housing, and the plurality of vent holes includes:

one or more suction holes that provide communication between the pump chamber and the first vent passage, one or more ejection holes that provide communication between the pump chamber and the second vent passage, one or more communication holes that provide communication between the pump chamber and valve chamber, and one or more film holes defined by the film.

10. The blower according to claim 8, the plurality of vent holes includes one or more ejection holes, one or more communication holes that provide communication between the pump chamber and valve chamber, and one or more film holes defined by the film, the one or more film holes opposing the one or more ejection holes and not opposing the one or more communication holes.

11. The blower according to claim 1, wherein the pump chamber is axisymmetric about the central axis.

12. The blower according to claim 1, wherein:

the outer housing includes a first nozzle surrounding the inlet and a second nozzle surrounding the outlet, and one of the first nozzle and the second nozzle is disposed on a straight line orthogonal to the central axis of the pump chamber.

13. The blower according to claim 1, wherein:

the outer housing includes a first nozzle surrounding the inlet and a second nozzle surrounding the outlet, and the first nozzle and the second nozzle are disposed at positions opposing to each other.

14. The blower according to claim 1, wherein:

the outer housing includes a first nozzle surrounding the inlet and a second nozzle surrounding the outlet, and an angle between a central axis of the first nozzle and a central axis of the second nozzle is smaller than or equal to 90 degrees.

15. The blower according to claim 1, wherein the at least one of the plurality of vent holes is displaced from the central axis of the pump chamber.

16. A blower comprising:

a pump unit including:

a vibrating body, a driving body vibrating the vibrating body, a pump chamber inside the pump unit, and a plurality of vent holes through which the pump chamber communicates with an outside of the pump unit, the plurality of vent holes being symmetric about a central axis of the pump chamber; and an outer housing covering the pump unit with a gap between the outer housing and the pump unit, wherein the outer housing has an inlet, an outlet, a first nozzle surrounding the inlet, and a second nozzle surrounding the outlet, wherein one of the first nozzle and the second nozzle is disposed on a straight line orthogonal to the central axis of the pump chamber, and wherein the pump unit is connected to the outer housing via an annular member that projects inward from the outer housing toward the central axis.

17. The blower according to claim 16, wherein:

the gap between the pump unit and outer housing defines a vent passage, and a distance from the central axis to a first end of the vent passage differs from a distance from the central axis to a second end of the vent passage.

18. The blower according to claim 16, wherein the pump chamber is axisymmetric about the central axis.

19. The blower according to claim 16, wherein:

the outer housing has an upper wall, a bottom wall, and a side wall extending from the upper wall to the bottom wall, and at least one of the inlet and the outlet is provided in the side wall of the outer housing.

20. The blower according to claim 16, wherein:

the pump unit further comprises a valve chamber inside the pump unit, and a film disposed in the valve chamber, and the plurality of vent holes includes one or more ejection holes, one or more film holes defined by the film, and one or more communication holes that provide communication between the pump chamber and valve chamber, the one or more film holes opposing the one or more ejection holes and not opposing the one or more communication holes.

21. A blower comprising:

a pump unit including:

a vibrating body, a driving body vibrating the vibrating body, a pump chamber inside the pump unit, and a plurality of vent holes through which the pump chamber communicates with an outside of the pump unit, the plurality of vent holes being symmetric about a central axis of the pump chamber; and an outer housing covering the pump unit with a gap between the outer housing and the pump unit, the outer housing comprising and inlet and an outlet, wherein the inlet and the outlet are both displaced from the central axis of the pump chamber, and wherein the pump unit is connected to the outer housing via an annular member that projects inward from the outer housing toward the central axis.

22. The blower according to claim 1, wherein the annular member is separate from the pump unit.

* * * * *